US011958583B2

(12) United States Patent
Shirao et al.

(10) Patent No.: US 11,958,583 B2
(45) Date of Patent: Apr. 16, 2024

(54) AUTOMATIC SETTING DEVICE, AUTOMATIC SETTING METHOD, AND PROGRAM

(71) Applicant: NHK SPRING Co., Ltd., Yokohama (JP)

(72) Inventors: Masato Shirao, Kanagawa (JP); Marino Akita, Yokohama (JP); Takafumi Oshima, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 319 days.

(21) Appl. No.: 17/616,297

(22) PCT Filed: Jun. 5, 2020

(86) PCT No.: PCT/JP2020/022229
§ 371 (c)(1),
(2) Date: Dec. 3, 2021

(87) PCT Pub. No.: WO2020/246568
PCT Pub. Date: Dec. 10, 2020

(65) Prior Publication Data

US 2022/0306262 A1 Sep. 29, 2022

(30) Foreign Application Priority Data

Jun. 6, 2019 (JP) ..... 2019-106523

(51) Int. Cl.
*B63H 25/42* (2006.01)
*B63H 25/02* (2006.01)
*B63H 20/00* (2006.01)

(52) U.S. Cl.
CPC ..... *B63H 25/42* (2013.01); *B63H 25/02* (2013.01); *B63H 2020/003* (2013.01); *B63H 2025/026* (2013.01)

(58) Field of Classification Search
CPC .. B63H 25/42; B63H 25/02; B63H 2020/003; B63H 2025/026
See application file for complete search history.

(56) References Cited

U.S. PATENT DOCUMENTS 7,267,068 B2 * 9/2007 Bradley ..... B63H 25/42 114/144 R
7,369,923 B2 * 5/2008 Yamakawa ..... G05B 13/0275 114/144 R (Continued)

FOREIGN PATENT DOCUMENTS

EP 2907740 A1 8/2015
EP 3434581 A1 1/2019

(Continued)

OTHER PUBLICATIONS

H. F. Harvey and W. E. Thau, "Electric Propulsion of Ships," in Transactions of the American Institute of Electrical Engineers, vol. XLIV, pp. 497-522, Jan.-Dec. 1925, doi: 10.1109/T-AIEE.1925.5061130. (Year: 1925).*

(Continued)

*Primary Examiner* — Gertrude Arthur Jeanglaude
(74) *Attorney, Agent, or Firm* — CANTOR COLBURN LLP

(57) ABSTRACT

This automatic setting device for automatically setting control devices for a plurality of ship propulsion apparatuses for generating ship propulsion forces is provided with: an input operation setting unit that sets an input operation for a ship; a target behavior acquisition unit that acquires a target behavior of the ship corresponding to the input operation set by the input operation setting unit; a ship information acquisition unit that acquires ship information about the position and/or the bearing of the ship; an actual behavior calculation unit that calculates the actual behavior of the ship on the basis of the ship information acquired by the ship (Continued)

information acquisition unit; and a propulsion force setting unit that sets the magnitudes and the directions of the propulsion forces generated by the respective ship propulsion apparatuses on the basis of the actual behavior of the ship acquired by the actual behavior calculation unit and the target behavior of the ship acquired by the target behavior acquisition unit.

10 Claims, 7 Drawing Sheets

(56) References Cited

U.S. PATENT DOCUMENTS

| | | | | |
|---|---|---|---|---|
| 8,589,004 | B1 * | 11/2013 | Kanno | B63H 25/42 440/4 |
| 8,807,059 | B1 * | 8/2014 | Samples | B63H 20/20 114/144 R |
| 9,126,667 | B2 * | 9/2015 | Mizutani | B63H 21/213 |
| 9,598,160 | B2 * | 3/2017 | Andrasko | B63H 20/08 |
| 9,764,810 | B1 | 9/2017 | Andrasko et al. | |
| 10,295,083 | B2 * | 5/2019 | Wang | G05D 1/0206 |
| 11,072,409 | B2 * | 7/2021 | Nilsson | B63B 34/05 |
| 2004/0193332 | A1 | 9/2004 | Yamakawa et al. | |
| 2005/0092225 | A1 | 5/2005 | Kaji et al. | |
| 2015/0166159 | A1 * | 6/2015 | Inoue | B63H 20/12 440/53 |

FOREIGN PATENT DOCUMENTS

| | | | |
|---|---|---|---|
| EP | 3437986 | A1 | 2/2019 |
| JP | 2004303085 | A | 10/2004 |
| JP | 2005145438 | A | 6/2005 |
| JP | 2008137545 | A | 6/2008 |
| JP | 2014076758 | A | 5/2014 |
| JP | 5764411 | B2 | 8/2015 |
| JP | 6430988 | B2 | 11/2018 |

OTHER PUBLICATIONS

EPO Extended European Search Report for corresponding EP Application 20817763.4; dated Jun. 23, 2023.

International Search Report for International Application No. PCT/JP2020/022229; dated Aug. 4, 2020.

* cited by examiner

FRONT
RIGHT
LEFT
REAR
P1
P2
P3
P4
P5
P6
P7
P8
P9
θ3
θ4
θ6
θ7

AUTOMATIC SETTING DEVICE, AUTOMATIC SETTING METHOD, AND PROGRAM

CROSS REFERENCE TO RELATED APPLICATIONS

This is the U.S. national stage of application No. PCT/JP2020/022229, filed on Jun. 5, 2020. Priority under 35 U.S.C. § 119(a) and 35 U.S.C. § 365(b) is claimed from Japanese Application No. 2019-106523, filed Jun. 6, 2019, the disclosure of which is also incorporated herein by reference.

TECHNICAL FIELD

The present invention relates to an automatic setting device, an automatic setting method, and a program.

BACKGROUND ART

Conventionally, a ship handling control device for controlling a plurality of propulsion devices configured to generate propulsion forces for a ship is known (see, for example, Patent Literature 1). In technology described in Patent Literature 1, for example, a calibration worker performs work such as calibration of turning of a bow (setting work for a ship handling control device). Specifically, in the technology described in Patent Literature 1, the calibration worker performs calibration work of changing a center position of turning of a bow of the ship by rotating a lever around a central axis of the lever of a joystick and tilting the lever.

Also, conventionally, a control device for controlling a plurality of propulsion devices for generating propulsion forces for a ship is known (see, for example, Patent Literature 2). In technology described in Patent Literature 2, an operator performs work such as the determination of a correction value (setting work for the control device). Specifically, in the technology described in Patent Literature 2, for example, the operator first performs a tilting operation on the joystick and causes the ship to perform oblique sailing in order to perform a setting process associated with the control device so that the ship does not rotate (yaw) when the ship is performing oblique sailing (a translational movement). In this step, because the setting process associated with the control device is not completed, the ship may yaw. Subsequently, the operator performs a twisting operation on the joystick and causes a bow turning moment to be generated in the ship in a direction in which the yawing of the ship is canceled out. As a result, the ship will not yaw. Subsequently, the operator turns on a correction control start switch. As a result, a value of the bow turning moment in the direction in which the yawing of the ship is canceled out is stored in the ship and the setting work associated with the control device for preventing the ship from yawing at the time of oblique sailing of the ship is completed.

Also, conventionally, a control device (a helm controller) for controlling a plurality of propulsion devices (outboard motors) configured to generate propulsion forces for a ship is known (see, for example, Patent Literature 3). In technology described in Patent Literature 3, a calibration worker performs work such as calibration of a rotation center position of the ship (the setting work associated with the control device). Specifically, in the technology described in Patent Literature 3, the calibration worker performs the calibration work of changing the rotation center position of the ship by tilting a lever of a joystick.

As described above, in the technologies described in Patent Literature 1 to 3, the worker must perform the setting work associated with the control device for a plurality of ship propulsion devices.

CITATION LIST

Patent Literature

[Patent Literature 1]
Japanese Patent No. 6430988
[Patent Literature 2]
Japanese Patent No. 5764411
[Patent Literature 3]
Japanese Unexamined Patent Application, First Publication No. 2014-076758

SUMMARY OF INVENTION

Technical Problem

In view of the above-mentioned problems, an objective of the present invention is to provide an automatic setting device, an automatic setting method, and a program capable of automatically setting a control device for ship propulsion devices without the need for a worker to perform all the setting work associated with the control device for the ship propulsion devices.

Solution to Problem

According to an aspect of the present invention, there is provided an automatic setting device for automatically setting a control device for a plurality of ship propulsion devices configured to generate propulsion forces of a ship, the automatic setting device including: an input operation setting unit configured to set an input operation for the ship; a target behavior acquisition unit configured to acquire target behavior of the ship corresponding to the input operation set by the input operation setting unit; a ship information acquisition unit configured to acquire ship information that is information about at least one of a position and a direction of the ship; an actual behavior calculation unit configured to calculate actual behavior of the ship on the basis of the ship information acquired by the ship information acquisition unit; and a propulsion force setting unit configured to set a magnitude and a direction of a propulsion force that is generated by each of the plurality of ship propulsion devices on the basis of the actual behavior of the ship calculated by the actual behavior calculation unit and the target behavior of the ship acquired by the target behavior acquisition unit, wherein the propulsion force setting unit includes an initial propulsion force setting unit configured to set a magnitude and a direction of a propulsion force that is initially generated by each of the plurality of ship propulsion devices as a magnitude and a direction of an initial propulsion force after the input operation for the ship is set by the input operation setting unit; and a setting value storage unit configured to store the magnitude and the direction of the propulsion force generated by each of the plurality of ship propulsion devices as propulsion force setting values when the actual behavior of the ship is within an allowable range of the target behavior of the ship.

According to an aspect of the present invention, there is provided an automatic setting method of automatically setting a control device for a plurality of ship propulsion devices configured to generate propulsion forces of a ship, the automatic setting method including: an input operation setting step of setting an input operation for the ship; a target behavior acquisition step of acquiring target behavior of the ship corresponding to the input operation set in the input operation setting step; a ship information acquisition step of acquiring ship information that is information about at least one of a position and a direction of the ship; an actual behavior calculation step of calculating actual behavior of the ship on the basis of the ship information acquired in the ship information acquisition step; and a propulsion force setting step of setting a magnitude and a direction of a propulsion force that is generated by each of the plurality of ship propulsion devices on the basis of the actual behavior of the ship calculated in the actual behavior calculation step and the target behavior of the ship acquired in the target behavior acquisition step, wherein the propulsion force setting step includes an initial propulsion force setting step of setting a magnitude and a direction of a propulsion force that is initially generated by each of the plurality of ship propulsion devices as a magnitude and a direction of an initial propulsion force after the input operation for the ship is set in the input operation setting step; and a setting value storage step of storing the magnitude and the direction of the propulsion force generated by each of the plurality of ship propulsion devices as propulsion force setting values when the actual behavior of the ship is within an allowable range of the target behavior of the ship.

According to an aspect of the present invention, there is provided a program for automatically setting a control device for a plurality of ship propulsion devices configured to generate propulsion forces of a ship, the program causing a computer to execute: an input operation setting step of setting an input operation for the ship; a target behavior acquisition step of acquiring target behavior of the ship corresponding to the input operation set in the input operation setting step; a ship information acquisition step of acquiring ship information that is information about at least one of a position and a direction of the ship; an actual behavior calculation step of calculating actual behavior of the ship on the basis of the ship information acquired in the ship information acquisition step; and a propulsion force setting step of setting a magnitude and a direction of a propulsion force that is generated by each of the plurality of ship propulsion devices on the basis of the actual behavior of the ship calculated in the actual behavior calculation step and the target behavior of the ship acquired in the target behavior acquisition step, wherein the propulsion force setting step includes an initial propulsion force setting step of setting a magnitude and a direction of a propulsion force that is initially generated by each of the plurality of ship propulsion devices as a magnitude and a direction of an initial propulsion force after the input operation for the ship is set in the input operation setting step; and a setting value storage step of storing the magnitude and the direction of the propulsion force generated by each of the plurality of ship propulsion devices as propulsion force setting values when the actual behavior of the ship is within an allowable range of the target behavior of the ship.

Advantageous Effects of Invention

According to the present invention, it is possible to provide an automatic setting device, an automatic setting method, and a program capable of automatically setting a control device for ship propulsion devices without the need for a worker to perform all the setting work associated with the control device for the ship propulsion devices.

DESCRIPTION OF EMBODIMENTS

First Embodiment

Before a first embodiment of an automatic setting device, an automatic setting method, and a program of the present invention is described, an example of a ship 1 having a control device 14 which is set by an automatic setting device A of the first embodiment will be described.

Figure 1:
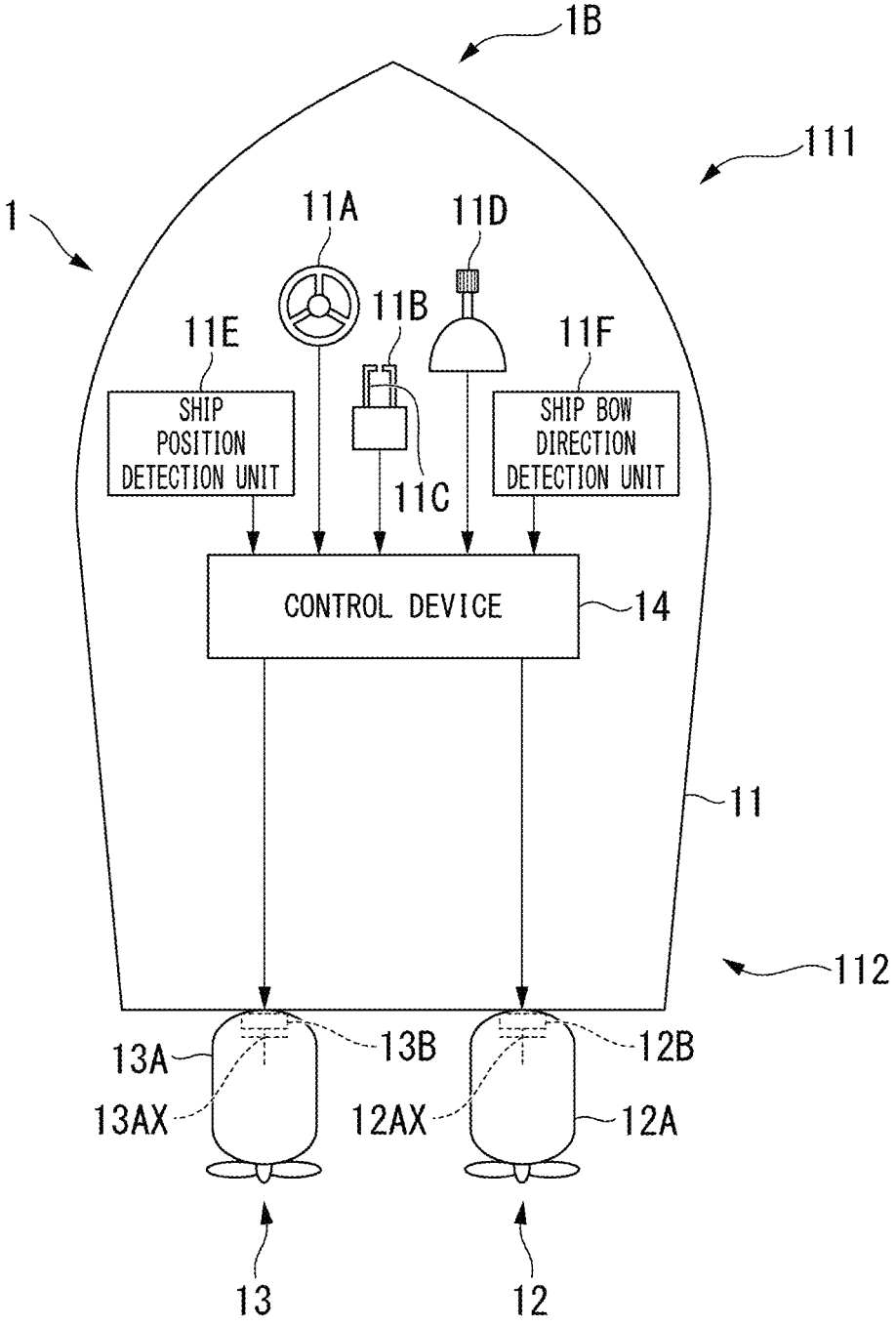
FIG. 1 is a diagram showing an example of a ship having a control device which is set by an automatic setting device of a first embodiment.
Figure 2:
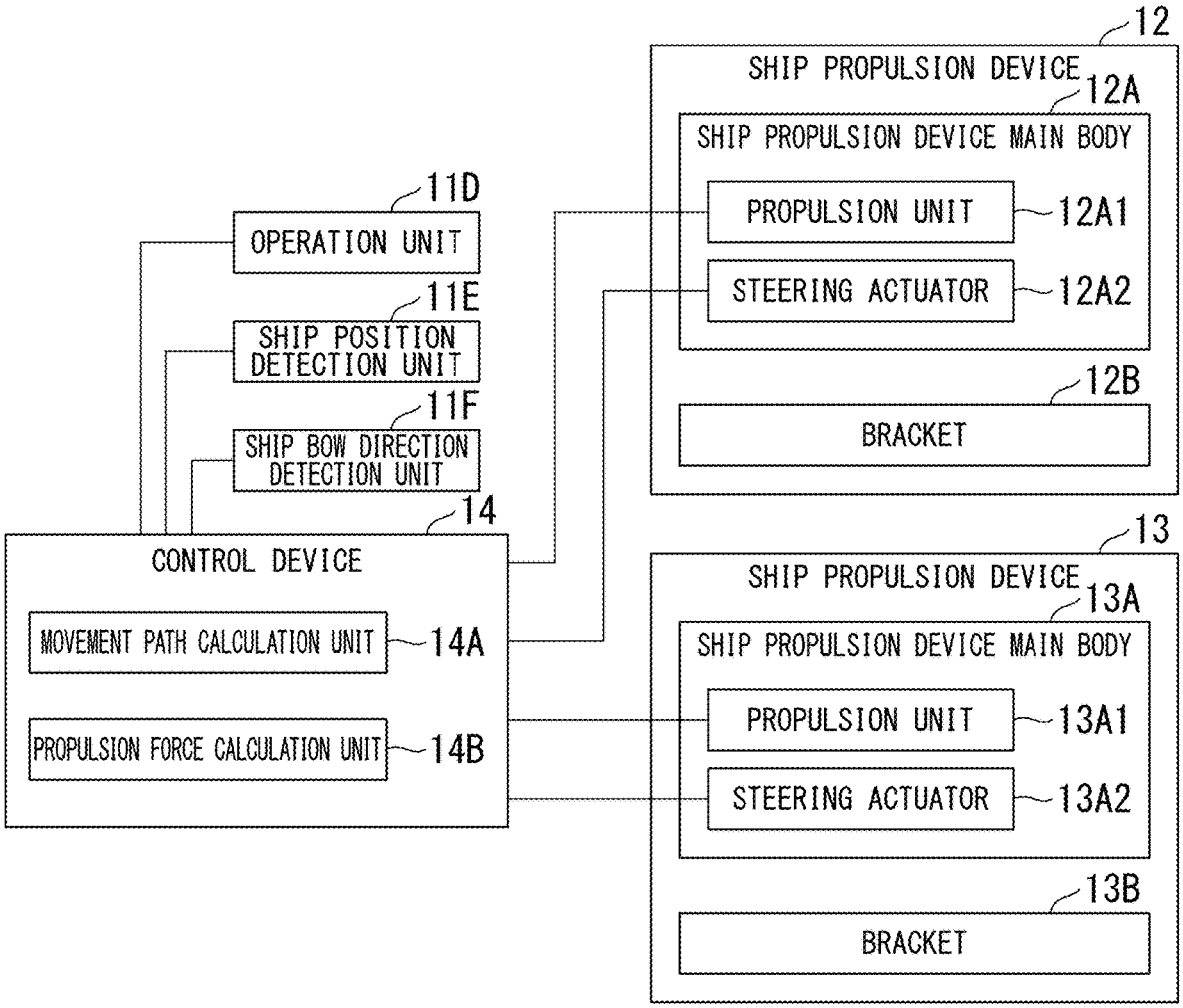
FIG. 2 is a functional block diagram of main parts of the ship shown in FIG. 1.

FIG. 1 is a diagram showing an example of the ship 1 having the control device 14 which is set by the automatic setting device A of the first embodiment. FIG. 2 is a functional block diagram of main parts of the ship 1 shown in FIG. 1.

In the examples shown in FIG. 1 and FIG. 2, the ship 1 includes a hull 11, a ship propulsion device 12, a ship propulsion device 13, and the control device 14. The ship propulsion devices 12 and 13 generate propulsion forces for the ship 1.

In the examples shown in FIG. 1 and FIG. 2, the ship propulsion device 12 is disposed on a right part of a rear portion 112 of the hull 11. The ship propulsion device 12 includes a ship propulsion device main body 12A and a bracket 12B. The bracket 12B is a mechanism for attaching the ship propulsion device 12 to the right part of the rear portion 112 of the hull 11. The ship propulsion device main body 12A is connected to the right part of the rear portion 112 of the hull 11 via the bracket 12B rotatably with respect to the hull 11 around a steering shaft 12AX.

The ship propulsion device main body 12A includes a propulsion unit 12A1 and a steering actuator 12A2. The propulsion unit 12A1 generates a propulsion force for the ship 1. The steering actuator 12A2 causes the entire ship propulsion device main body 12A including the propulsion unit 12A1 to rotate with respect to the hull 11 around the steering shaft 12AX. The steering actuator 12A2 serves as a rudder.

In the examples shown in FIG. 1 and FIG. 2, the ship propulsion device 13 is disposed on a left part of the rear portion 112 of the hull 11. The ship propulsion device 13 includes a ship propulsion device main body 13A and a bracket 13B. The bracket 13B is a mechanism for attaching the ship propulsion device 13 to the left part of the rear portion 112 of the hull 11. The ship propulsion device main body 13A is connected to the left part of the rear portion 112 of the hull 11 via the bracket 13B rotatably with respect to the hull 11 around a steering shaft 13AX.

The ship propulsion device main body 13A includes a propulsion unit 13A1 and a steering actuator 13A2. The propulsion unit 13A1 generates the propulsion force for the ship 1 like the propulsion unit 12A1. The steering actuator 13A2 causes the entire ship propulsion device main body 13A including the propulsion unit 13A1 to rotate with respect to the hull 11 around the steering shaft 13AX. The steering actuator 13A2 serves as a rudder.

In the examples shown in FIG. 1 and FIG. 2, the ship propulsion devices 12 and 13 are outboard motors having propeller-specification propulsion units 12A1 and 13A1 driven by, for example, an engine (not shown). In another example, each of the ship propulsion devices 12 and 13 may be an inboard motor having a propeller-specific propulsion unit, an inboard/outboard motor having a propeller-specification propulsion unit, a ship propulsion device having a water jet-specification propulsion unit, a pod drive type ship propulsion device, or the like. In yet another example, each of the ship propulsion devices 12 and 13 may be, for example, a ship propulsion device having a propulsion unit driven by an electric motor (not shown).

In the example shown in FIG. 1 and FIG. 2, the hull 11 includes a steering device 11A, a remote control device 11B, a remote control device 11C, an operation unit 11D, a ship position detection unit 11E, and a ship bow direction detection unit 11F.

In another example, the hull 11 may not include the steering device 11A, the remote control device 11B, and the remote control device 11C.

In yet another example, the hull 11 may not include one of the ship position detection unit 11E and the ship bow direction detection unit 11F.

In the example shown in FIG. 1 and FIG. 2, the steering device 11A is a device that operates the steering actuators 12A2 and 13A2, and is, for example, a steering device having a steering wheel. By operating the steering device 11A, the ship operator can operate the steering actuators 12A2 and 13A2 to steer the ship 1.

The remote control device 11B is a device that receives an input operation for operating the propulsion unit 12A1, and has, for example, a remote control lever. The ship operator can change a magnitude and a direction of the propulsion force generated by the propulsion unit 12A1 by operating the remote control device 11B. The remote control lever of the remote control device 11B can be positioned in a forward movement region where the propulsion unit 12A1 generates a forward propulsion force for the ship 1, a backward movement region where the propulsion unit 12A1 generates a backward propulsion force for the ship 1, and a neutral region where the propulsion unit 12A1 does not generate a propulsion force. A magnitude of the forward propulsion force for the ship 1 generated by the propulsion unit 12A1 changes in accordance with the position of the remote control lever within the forward movement region. Also, a magnitude of the backward propulsion force for the ship 1 generated by the propulsion unit 12A1 changes in accordance with the position of the remote control lever within the backward movement region.

In the examples shown in FIG. 1 and FIG. 2, the remote control device 11C is a device that receives an input operation for operating the propulsion unit 13A1, and is configured like the remote control device 11B. That is, the ship operator can change a magnitude and a direction of the propulsion force generated by the propulsion unit 13A1 by operating the remote control device 11C.

The operation unit 11D is a device that operates the propulsion units 12A1 and 13A1 and the steering actuators 12A2 and 13A2. Specifically, the operation unit 11D receives an input operation for operating the propulsion units 12A1 and 13A1 and the steering actuators 12A2 and 13A2. The operation unit 11D is provided separately from the steering device 11A and the remote control devices 11B and 11C.

In the ship 1 of the first embodiment, the operation unit 11D includes a joystick having a lever.

The ship operator can not only operate the propulsion units 12A1 and 13A1 and the steering actuators 12A2 and 13A2 by operating the steering device 11A (the steering wheel) and the remote control devices 11B and 11C (the remote control levers), but also operate the propulsion units 12A1 and 13A1 and the steering actuators 12A2 and 13A2 by operating the operation unit 11D (the joystick).

In the examples shown in FIG. 1 and FIG. 2, the ship position detection unit 11E detects the position of the ship 1. The ship position detection unit 11E includes, for example, a Global Positioning System (GPS) device. The GPS device calculates position coordinates of the ship 1 by receiving signals from a plurality of GPS satellites.

The ship bow direction detection unit 11F detects a direction of a bow 1B of the ship 1. The ship bow direction detection unit 11F includes, for example, a direction sensor. The direction sensor calculates a direction of the bow 1B using, for example, geomagnetism.

In another example, the direction sensor may be a device (a gyrocompass) in which a north-seeking device and a vibration damping device are added to a gyroscope that rotates at a high speed so that the north is indicated all the time.

In yet another example, the direction sensor may be a GPS compass including a plurality of GPS antennas and configured to calculate the direction of the bow 1B from a relative positional relationship of the plurality of GPS antennas.

In the example shown in FIG. 1 and FIG. 2, the control device 14 controls the propulsion unit 12A1 and the steering actuator 12A2 of the ship propulsion device 12 and the propulsion unit 13A1 and the steering actuator 13A2 of the ship propulsion device 13 on the basis of an input operation on the operation unit 11D. Specifically, the control device 14 controls magnitudes and directions of the propulsion forces for the ship 1 generated by the propulsion units 12A1 and 13A1 and the steering actuators 12A2 and 13A2 on the basis of an input operation on the operation unit 11D.

As will be described in detail below, the automatic setting device A (see FIG. 4) of the first embodiment performs a setting corresponding relationships between the input operation on the operation unit 11D and the magnitudes and the directions of the propulsion forces for the ship 1 generated by the propulsion units 12A1 and 13A1 and the steering actuators 12A2 and 13A2.

In the examples shown in FIG. 1 and FIG. 2, the control device 14 includes a movement path calculation unit 14A and a propulsion force calculation unit 14B. The movement path calculation unit 14A calculates a movement path of the operation unit 11D. Specifically, the movement path calculation unit 14A calculates a movement path of the tip of the lever of the joystick on the basis of a position of the lever of the joystick detected by a sensor (not shown) such as a microswitch. Also, the movement path calculation unit 14A identifies an input operation received by the operation unit 11D on the basis of the movement path of the tip of the lever of the joystick (i.e., identifies what type of input operation the operation unit 11D receives).

The propulsion force calculation unit 14B calculates the propulsion forces generated by the ship propulsion devices 12 and 13 on the basis of the movement path of the operation unit 11D calculated by the movement path calculation unit 14A (i.e., on the basis of the input operation on the operation unit 11D identified by the movement path calculation unit 14A). Specifically, the propulsion force calculation unit 14B calculates magnitudes and directions of the propulsion forces for the ship 1 that are generated by the propulsion units 12A1 and 13A1 and the steering actuators 12A2 and 13A2 on the basis of the input operation identified by the movement path calculation unit 14A.

That is, the control device 14 controls the propulsion units 12A1 and 13A1 and the steering actuators 12A2 and 13A2 so that the propulsion units 12A1 and 13A1 and the steering actuators 12A2 and 13A2 generate the propulsion forces of the magnitudes and directions calculated by the propulsion force calculation unit 14B.

As will be described in detail below, the automatic setting device A (see FIG. 4) of the first embodiment performs a setting what types of propulsion forces the propulsion units 12A1 and 13A1 and the steering actuators 12A2 and 13A2 generate when the operation unit 11D receives an input operation.

In the examples shown in FIG. 1 and FIG. 2, the operation unit 11D (the joystick) is configured so that the lever of the operation unit 11D can be tilted and the lever can rotate around the central axis of the lever.

When the ship operator rotates the lever clockwise around the central axis of the lever of the operation unit 11D, the control device 14 controls the propulsion units 12A1 and 13A1 and the steering actuators 12A2 and 13A2 so that the ship 1 turns clockwise on the spot and the front portion 111 of the hull 11 relatively moves to the right with respect to the rear portion 112.

That is, when the operation unit 11D receives an input operation for rotating the lever clockwise around the central axis of the lever, the automatic setting device A (see FIG. 4) of the first embodiment sets the control device 14 so that the propulsion units 12A1 and 13A1 and the steering actuators 12A2 and 13A2 generate the propulsion forces for turning the ship 1 clockwise on the spot.

According to the magnitudes and the directions of the propulsion forces generated by the propulsion units 12A1 and 13A1 and the steering actuators 12A2 and 13A2, the ship 1 may not turn clockwise on the spot and, for example, the ship 1 can make a large right turn (make a right turn having a radius of curvature). When the ship 1 does not turn clockwise on the spot, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 turns clockwise on the spot by using detection results of, for example, the ship position detection unit 11E, the ship bow direction detection unit 11F, and the like.

When the ship operator rotates the lever counterclockwise around the central axis of the lever of the operation unit 11D, the control device 14 controls the propulsion units 12A1 and 13A1 and the steering actuators 12A2 and 13A2 so that the ship 1 turns counterclockwise on the spot and the front portion 111 of the hull 11 relatively moves to the left with respect to the rear portion 112.

That is, when the operation unit 11D receives an input operation for rotating the lever counterclockwise around the central axis of the lever, the automatic setting device A (see FIG. 4) of the first embodiment sets the control device 14 so that the propulsion units 12A1 and 13A1 and the steering actuators 12A2 and 13A2 generate the propulsion forces for turning the ship 1 counterclockwise on the spot.

According to the magnitudes and the directions of the propulsion forces generated by the propulsion units 12A1 and 13A1 and the steering actuators 12A2 and 13A2, the ship 1 may not turn counterclockwise on the spot and, for example, the ship 1 can make a large left turn (make a left turn having a radius of curvature). When the ship 1 does not turn counterclockwise on the spot, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 turns counterclockwise on the spot by using detection results of, for example, the ship position detection unit 11E, the ship bow direction detection unit 11F, and the like.

FIG. 3A to FIG. 3I is a diagram for describing an example of positions of the operation unit 11D shown in FIG. 1 (specifically, positions P1 to P9 of the tip of the lever of the joystick).

Figures 3A, 3B, 3C, 3D, 3E, 3F, 3G, 3H, 3I:
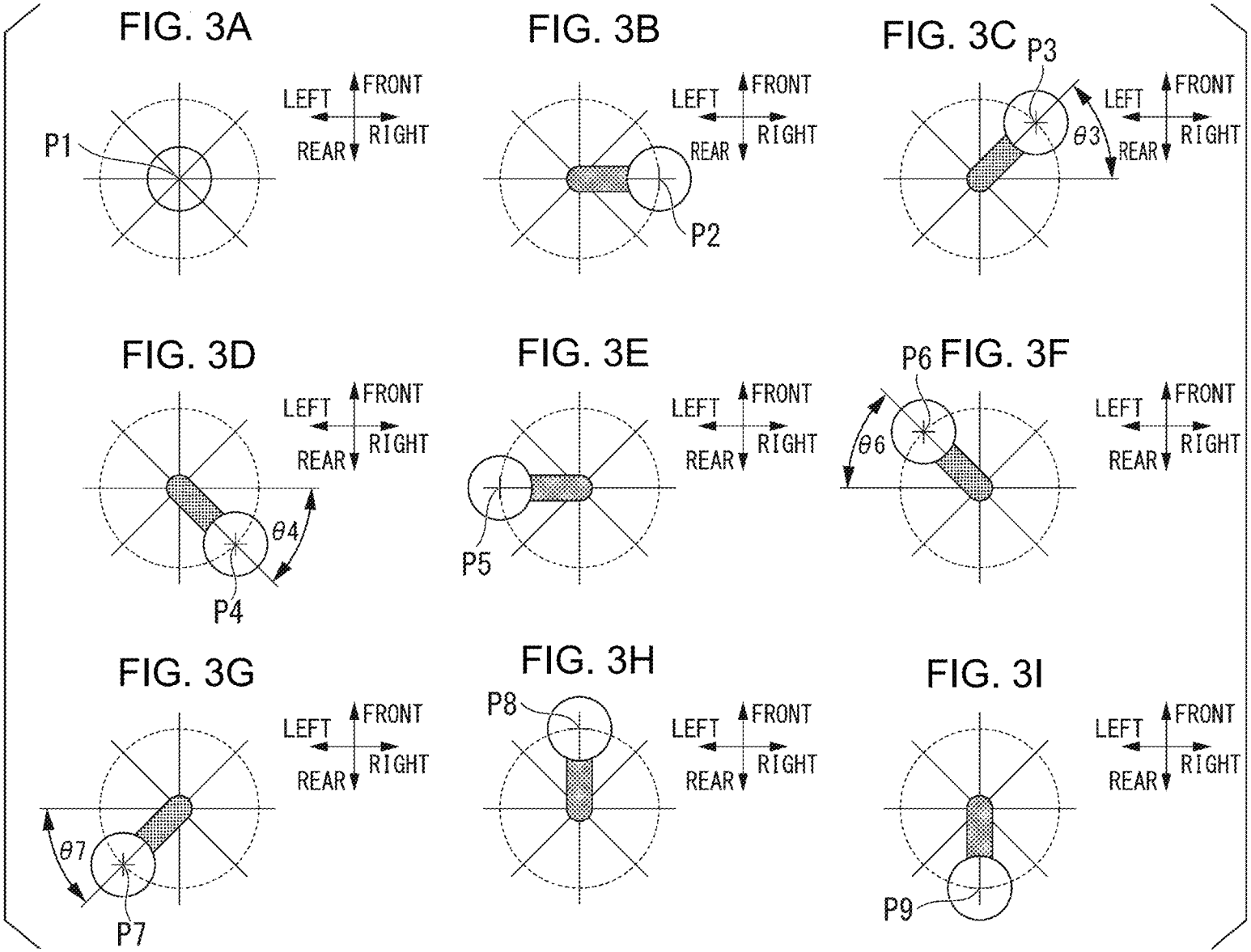
FIGS. 3A to FIG. 3I is a diagram for describing an example of positions of an operation unit shown in FIG. 1.

In the example shown in FIG. 3A, the lever of the operation unit 11D (the joystick) is not tilted. Thus, the operation unit 11D (specifically, the tip of the lever of the joystick) is positioned at the position (neutral position) P1. When the operation unit 11D (the tip of the lever of the joystick) is positioned at the position P1, the control device 14 does not cause the propulsion units 12A1 and 13A1 and the steering actuators 12A2 and 13A2 to generate the propulsion forces for the ship 1.

That is, the position P1 is a position where the ship propulsion devices 12 and 13 do not generate the propulsion forces for the ship 1.

When the operation unit 11D does not receive an input operation and the tip of the lever of the operation unit 11D is positioned at the position P1, the automatic setting device A (see FIG. 4) of the first embodiment sets the control device 14 so that the ship propulsion devices 12 and 13 do not generate the propulsion forces for the ship 1.

In the example shown in FIG. 3B, the lever of the joystick is tilted to the right. Thus, the tip of the lever of the joystick is positioned at the position P2 on the right side of the position P1. When the tip of the lever of the joystick is positioned at the position P2, the control device 14 causes the propulsion units 12A1 and 13A1 and the steering actuators 12A2 and 13A2 to generate propulsion forces for moving the ship 1 to the right.

That is, the position P2 is a position where the ship propulsion devices 12 and 13 generate a propulsion force for moving the ship 1 to the right (specifically, a translational movement).

When the operation unit 11D receives an input operation for moving the tip of the lever from the position P1 to the position P2, the automatic setting device A (see FIG. 4) of the first embodiment sets the control device 14 so that the propulsion units 12A1 and 13A1 and the steering actuators 12A2 and 13A2 generate propulsion forces for causing the ship 1 to perform a translational movement in a right direction.

According to the magnitudes and the directions of the propulsion forces generated by the propulsion units 12A1 and 13A1 and the steering actuators 12A2 and 13A2, the ship 1 may not perform the translational movement in the right direction and, for example, the ship 1 can perform a translational movement in a right-forward direction or a right-backward direction or turn to the right. When the ship 1 does not perform the translational movement in the right direction, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 performs the translational movement in the right direction by using detection results of, for example, the ship position detection unit 11E, the ship bow direction detection unit 11F, and the like.

In the example shown in FIG. 3C, the lever of the joystick is tilted in a right-forward direction. Thus, the tip of the lever of the joystick is positioned at the position P3 on the right front side of the position P1. When the tip of the lever of the joystick is positioned at the position P3, the control device 14 causes the propulsion units 12A1 and 13A1 and the steering actuators 12A2 and 13A2 to generate propulsion forces for moving the ship 1 in a right-forward direction forming an acute angle θ3 with respect to the left-to-right direction.

That is, the position P3 is a position where the ship propulsion devices 12 and 13 generate propulsion forces for moving the ship 1 in the right-forward direction (a translational movement).

When the operation unit 11D receives an input operation for moving the tip of the lever from the position P1 to the position P3, the automatic setting device A (see FIG. 4) of the first embodiment sets the control device 14 so that the propulsion units 12A1 and 13A1 and the steering actuators 12A2 and 13A2 generate propulsion forces for causing the ship 1 to perform a translational movement in the right-forward direction.

When the ship 1 does not perform a translational movement in the right-forward direction, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 performs the translational movement in the right-forward direction by using detection results of, for example, the ship position detection unit 11E, the ship bow direction detection unit 11F, and the like.

In the example shown in FIG. 3D, the lever of the joystick is tilted in a right-backward direction. Thus, the tip of the lever of the joystick is positioned at the position P4 on the right rear side of the position P1. When the tip of the lever of the joystick is positioned at the position P4, the control device 14 causes the propulsion units 12A1 and 13A1 and the steering actuators 12A2 and 13A2 to generate propulsion forces for moving the ship 1 in a right-backward direction forming an acute angle θ4 with respect to the left-to-right direction.

That is, the position P4 is a position where the ship propulsion devices 12 and 13 generate propulsion forces for moving the ship 1 in the right-backward direction (a translational movement).

When the operation unit 11D receives an input operation for moving the tip of the lever from the position P1 to the position P4, the automatic setting device A (see FIG. 4) of the first embodiment sets the control device 14 so that the propulsion units 12A1 and 13A1 and the steering actuators 12A2 and 13A2 generate propulsion forces for causing the ship 1 to perform a translational movement in the right-backward direction.

When the ship 1 does not perform a translational movement in the right-backward direction, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 performs the translational movement in the right-backward direction by using detection results of, for example, the ship position detection unit 11E, the ship bow direction detection unit 11F, and the like.

In the example shown in FIG. 3E, the lever of the joystick is tilted to the left. Thus, the tip of the lever of the joystick is positioned at the position P5 on the left side of the position P1. When the tip of the lever of the joystick is positioned at the position P5, the control device 14 causes the propulsion units 12A1 and 13A1 and the steering actuators 12A2 and 13A2 to generate propulsion forces for moving the ship 1 to the left.

That is, the position P5 is a position where the ship propulsion devices 12 and 13 generate a propulsion force for moving the ship 1 to the left (a translational movement).

When the operation unit 11D receives an input operation for moving the tip of the lever from the position P1 to the position P5, the automatic setting device A (see FIG. 4) of the first embodiment sets the control device 14 so that the propulsion units 12A1 and 13A1 and the steering actuators 12A2 and 13A2 generate propulsion forces for causing the ship 1 to perform a translational movement in a left direction.

According to the magnitudes and the directions of the propulsion forces generated by the propulsion units 12A1 and 13A1 and the steering actuators 12A2 and 13A2, the ship 1 may not perform the translational movement in the left direction and, for example, the ship 1 can perform a translational movement in a left-forward direction or a left-backward direction or turn to the left. When the ship 1 does not perform the translational movement in the left direction, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 performs the translational movement in the left direction by using detection results of, for example, the ship position detection unit 11E, the ship bow direction detection unit 11F, and the like.

In the example shown in FIG. 3F, the lever of the joystick is tilted in a left-forward direction. Thus, the tip of the lever of the joystick is positioned at the position P6 on the left front side of the position P1. When the tip of the lever of the joystick is positioned at the position P6, the control device 14 causes the propulsion units 12A1 and 13A1 and the steering actuators 12A2 and 13A2 to generate propulsion forces for moving the ship 1 in a left-forward direction forming an acute angle θ6 with respect to the left-to-right direction.

That is, the position P6 is a position where the ship propulsion devices 12 and 13 generate propulsion forces for moving the ship 1 in the left-forward direction (a translational movement).

When the operation unit 11D receives an input operation for moving the tip of the lever from the position P1 to the position P6, the automatic setting device A (see FIG. 4) of the first embodiment sets the control device 14 so that the propulsion units 12A1 and 13A1 and the steering actuators 12A2 and 13A2 generate propulsion forces for causing the ship 1 to perform a translational movement in the left-forward direction.

When the ship 1 does not perform a translational movement in the left-forward direction, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 performs the translational movement in the left-forward direction by using detection results of, for example, the ship position detection unit 11E, the ship bow direction detection unit 11F, and the like.

In the example shown in FIG. 3G, the lever of the joystick is tilted in a left-backward direction. Thus, the tip of the lever of the joystick is positioned at the position P7 on the left rear side of the position P1. When the tip of the lever of the joystick is positioned at the position P7, the control device 14 causes the propulsion units 12A1 and 13A1 and the steering actuators 12A2 and 13A2 to generate propulsion forces for moving the ship 1 in a left-backward direction forming an acute angle θ7 with respect to the left-to-right direction.

That is, the position P7 is a position where the ship propulsion devices 12 and 13 generate propulsion forces for moving the ship 1 in the left-backward direction (a translational movement).

When the operation unit 11D receives an input operation for moving the tip of the lever from the position P1 to the position P7, the automatic setting device A (see FIG. 4) of the first embodiment sets the control device 14 so that the propulsion units 12A1 and 13A1 and the steering actuators 12A2 and 13A2 generate propulsion forces for causing the ship 1 to perform a translational movement in the left-backward direction.

When the ship 1 does not perform a translational movement in the left-backward direction, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 performs the translational movement in the left-backward direction by using detection results of, for example, the ship position detection unit 11E, the ship bow direction detection unit 11F, and the like.

In the example shown in FIG. 3H, the lever of the joystick is tilted forward. Thus, the tip of the lever of the joystick is positioned at the position P8 on the front side of the position P1. When the tip of the lever of the joystick is positioned at the position P8, the control device 14 causes the propulsion units 12A1 and 13A1 and the steering actuators 12A2 and 13A2 to generate a propulsion force for moving the ship 1 forward.

That is, the position P8 is a position where the ship propulsion devices 12 and 13 generate propulsion forces for moving the ship 1 forward.

When the operation unit 11D receives an input operation for moving the tip of the lever from the position P1 to the position P8, the automatic setting device A (see FIG. 4) of the first embodiment sets the control device 14 so that the propulsion units 12A1 and 13A1 and the steering actuators 12A2 and 13A2 generate propulsion forces for causing the ship 1 to move forward.

According to the magnitudes and the directions of the propulsion forces generated by the propulsion units 12A1 and 13A1 and the steering actuators 12A2 and 13A2, the ship 1 may not move forward and, for example, the ship 1 can move in a right-forward direction or a left-forward direction, turn to the right, or turn to the left. When the ship 1 does not move forward, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 moves forward by using detection results of, for example, the ship position detection unit 11E, the ship bow direction detection unit 11F, and the like.

In the example shown in FIG. 3I, the lever of the joystick is tilted backward. Thus, the tip of the lever of the joystick is positioned at the position P9 on the rear side of the position P1. When the tip of the lever of the joystick is positioned at the position P9, the control device 14 causes the propulsion units 12A1 and 13A1 and the steering actuators 12A2 and 13A2 to generate a propulsion force for moving the ship 1 backward.

That is, the position P9 is a position where the ship propulsion devices 12 and 13 generate propulsion forces for moving the ship 1 backward.

When the operation unit 11D receives an input operation for moving the tip of the lever from the position P1 to the position P9, the automatic setting device A (see FIG. 4) of the first embodiment sets the control device 14 so that the propulsion units 12A1 and 13A1 and the steering actuators 12A2 and 13A2 generate propulsion forces for causing the ship 1 to move backward.

According to the magnitudes and the directions of the propulsion forces generated by the propulsion units 12A1 and 13A1 and the steering actuators 12A2 and 13A2, the ship 1 may not move backward and, for example, the ship 1 can move in a right-backward direction or a left-backward direction, turn to the right, or turn to the left. When the ship 1 does not move backward, the automatic setting device A makes an adjustment to the control device 14 (adjustments to the magnitudes and the directions of the propulsion forces that are generated by the propulsion units 12A1 and 13A1 and the steering actuators 12A2 and 13A2) so that the ship 1 moves backward by using detection results of, for example, the ship position detection unit 11E, the ship bow direction detection unit 11F, and the like.

When the ship operator does not operate the operation unit 11D (the joystick), the tip of the lever of the joystick having an automatic return function is positioned at the position P1. The tip of the lever of the joystick can be positioned at positions such as the positions P1 to P9 in accordance with an operation of the ship operator.

Figure 4:
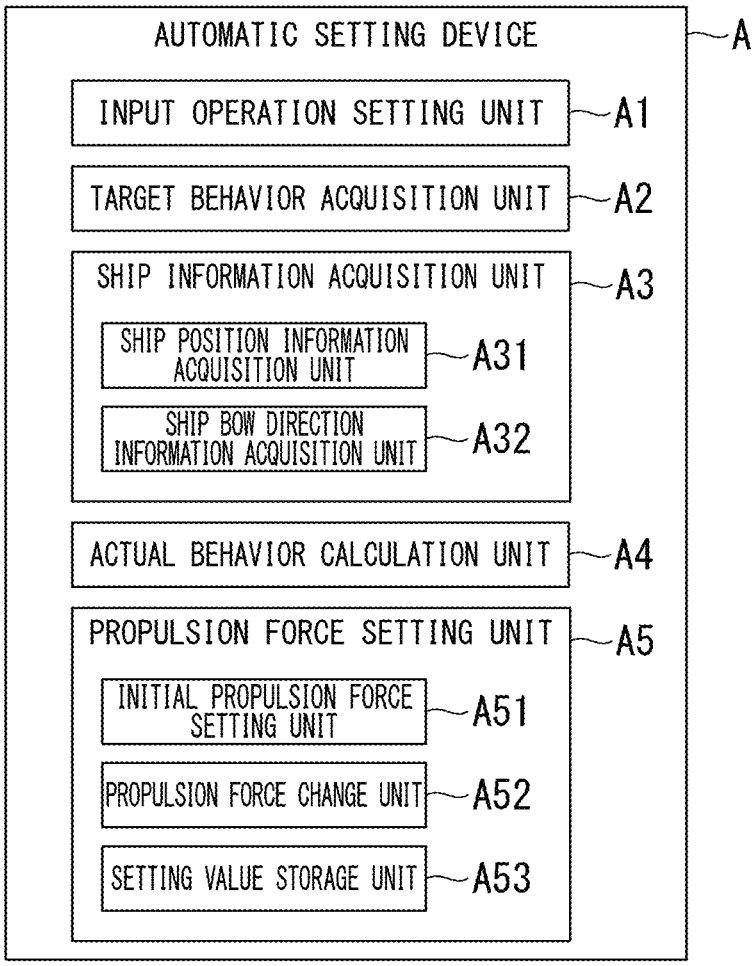
FIG. 4 is a diagram showing an example of the automatic setting device of the first embodiment.

FIG. 4 is a diagram showing an example of the automatic setting device A of the first embodiment.

In the example shown in FIG. 4, the automatic setting device A automatically sets the control device 14 shown in FIGS. 1 and 2 (i.e., performs a setting of the magnitudes and the directions of the propulsion forces that are generated by the propulsion units 12A1 and 13A1 and the steering actuators 12A2 and 13A2). The automatic setting device A includes an input operation setting unit A1, a target behavior acquisition unit A2, a ship information acquisition unit A3, an actual behavior calculation unit A4, and a propulsion force setting unit A5.

The input operation setting unit A1 sets an input operation on, for example, the operation unit 11D of the ship 1 (for example, an input operation received by the operation unit 11D).

The target behavior acquisition unit A2 acquires target behavior of the ship 1 corresponding to the input operation set by the input operation setting unit A1.

In the example shown in FIG. 4, the ship information acquisition unit A3 acquires information about a position of the ship 1 and information about a direction of the ship 1 as ship information. The ship information acquisition unit A3 includes a ship position information acquisition unit A31 and a ship bow direction information acquisition unit A32. The ship position information acquisition unit A31 acquires information about a current position of the ship 1 detected by, for example, the ship position detection unit 11E, and information (a past log) about a past position of the ship 1 detected by, for example, the ship position detection unit 11E, and stored in, for example, a storage unit (not shown) of the ship 1, and the like as the ship information. The ship bow direction information acquisition unit A32 acquires information about a current direction of the bow 1B of the ship 1 detected by, for example, the ship bow direction detection unit 11F, and information (a past log) about a past direction of the bow 1B of the ship 1 detected by, for example, the ship bow direction detection unit 11F, and stored in, for example, a storage unit of the ship 1, and the like as the ship information.

Although the ship information acquisition unit A3 acquires information about the position of the ship 1 and information about the direction of the ship 1 as ship information in the example shown in FIG. 4, the ship information acquisition unit A3 may acquire only one of the information about the position of the ship 1 and the information about the direction of the ship 1 as the ship information in another example.

Although the ship information acquisition unit A3 acquires the current ship information and the past ship information (the past log) in the example shown in FIG. 4, the ship information acquisition unit A3 may acquire only the current ship information in another example.

In the example shown in FIG. 4, the actual behavior calculation unit A4 calculates actual behavior of the ship 1 on the basis of the ship information acquired by the ship information acquisition unit A3. For example, the actual behavior calculation unit A4 calculates the actual behavior of the ship 1 on the basis of the information about the current position of the ship 1 detected by the ship position detection unit 11E, the information about the past position of the ship 1 detected by the ship position detection unit 11E and stored in, for example, the storage unit of the ship 1, and the like, the information about the current direction of the bow 1B of the ship 1 detected by the ship bow direction detection unit 11F, the information about the past direction of the bow 1B of the ship 1 detected by the ship bow direction detection unit 11F and stored in, for example, the storage unit of the ship 1 and the like, and the like.

The propulsion force setting unit A5 sets magnitudes and directions of the propulsion forces that are generated by the propulsion units 12A1 and 13A1 and the steering actuators 12A2 and 13A2 on the basis of the actual behavior of the ship 1 calculated by the actual behavior calculation unit A4 and the target behavior of the ship 1 acquired by the target behavior acquisition unit A2. Specifically, the propulsion force setting unit A5 includes an initial propulsion force setting unit A51, a propulsion force change unit A52, and a setting value storage unit A53.

The initial propulsion force setting unit A51 sets the magnitudes and the directions of the propulsion forces that are initially generated by the propulsion units 12A1 and 13A1 and the steering actuators 12A2 and 13A2 as magnitudes and directions of initial propulsion forces after an input operation for, for example, the operation unit 11D of the ship 1, is set by the input operation setting unit A1.

The propulsion force change unit A52 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior of the ship 1 calculated by the actual behavior calculation unit A4 approaches the target behavior of the ship 1 acquired by the target behavior acquisition unit A2.

The setting value storage unit A53 stores the magnitudes and the directions of the propulsion forces that are generated by the propulsion units 12A1 and 13A1 and the steering actuators 12A2 and 13A2 when the actual behavior of the ship 1 is within an allowable range of the target behavior of the ship 1 as propulsion force setting values.

Although the propulsion force setting unit A5 includes an initial propulsion force setting unit A51, a propulsion force change unit A52, and a setting value storage unit A53 in the example shown in FIG. 4, the propulsion force setting unit A5 may include the initial propulsion force setting unit A51 and the setting value storage unit A53 without including the propulsion force change unit A52 in another example. In the present example, a worker (for example, a user of the automatic setting device A) performs a process of changing at least one of the magnitudes and the directions of the propulsion forces that are generated by the propulsion units 12A1 and 13A1 and the steering actuators 12A2 and 13A2 so that the actual behavior of the ship 1 calculated by the actual behavior calculation unit A4 approaches the target behavior of the ship 1 acquired by the target behavior acquisition unit A2.

In the example shown in FIGS. 1 to 4, the user of the automatic setting device A causes the automatic setting device A to set magnitudes and directions of the propulsion forces that are generated by the propulsion units 12A1 and 13A1 and the steering actuators 12A2 and 13A2 when the ship 1 is turned clockwise on the spot and set magnitudes and directions of the propulsion forces that are generated by the propulsion units 12A1 and 13A1 and the steering actuators 12A2 and 13A2 when the ship 1 is turned counterclockwise on the spot.

Thus, in the examples shown in FIGS. 1 to 4, for example, the user of the automatic setting device A inputs "turning clockwise on the spot" and "turning counterclockwise on the spot" as the target behavior of the ship 1 to the automatic setting device A.

Further, in the examples shown in FIGS. 1 to 4, the user of the automatic setting device A causes the automatic setting device A to set magnitudes and directions of the propulsion forces that are generated by the propulsion units 12A1 and 13A1 and the steering actuators 12A2 and 13A2 when the ship 1 performs a translational movement in the right direction, set magnitudes and directions of the propulsion forces that are generated by the propulsion units 12A1 and 13A1 and the steering actuators 12A2 and 13A2 when the ship 1 performs a translational movement in the right-forward direction, and set magnitudes and directions of the propulsion forces that are generated by the propulsion units 12A1 and 13A1 and the steering actuators 12A2 and 13A2 when the ship 1 performs a translational movement in the right-backward direction.

Thus, in the examples shown in FIGS. 1 to 4, the user of the automatic setting device A inputs "rightward translational movement," "right-forward translational movement," and "right-backward translational movement" as the target behavior of the ship 1 to the automatic setting device A.

Further, in the examples shown in FIGS. 1 to 4, the user of the automatic setting device A causes the automatic setting device A to set magnitudes and directions of the propulsion forces that are generated by the propulsion units 12A1 and 13A1 and the steering actuators 12A2 and 13A2 when the ship 1 performs a translational movement in the left direction, set magnitudes and directions of the propulsion forces that are generated by the propulsion units 12A1 and 13A1 and the steering actuators 12A2 and 13A2 when the ship 1 performs a translational movement in the left-forward direction, and set magnitudes and directions of the propulsion forces that are generated by the propulsion units 12A1 and 13A1 and the steering actuators 12A2 and 13A2 when the ship 1 performs a translational movement in the left-backward direction.

Thus, in the examples shown in FIGS. 1 to 4, the user of the automatic setting device A inputs "leftward translational movement," "left-forward translational movement," and "left-backward translational movement" as the target behavior of the ship 1 to the automatic setting device A.

Also, in the example shown in FIGS. 1 to 4, the user of the automatic setting device A causes the automatic setting device A to set magnitudes and directions of the propulsion forces that are generated by the propulsion units 12A1 and 13A1 and the steering actuators 12A2 and 13A2 when the ship 1 is moved forward and set magnitudes and directions of the propulsion forces that are generated by the propulsion units 12A1 and 13A1 and the steering actuators 12A2 and 13A2 when the ship 1 is moved backward.

Thus, in the examples shown in FIGS. 1 to 4, the user of the automatic setting device A inputs "forward movement" and "backward movement" as the target behavior of the ship 1 to the automatic setting device A.

Next, in the example shown in FIGS. 1 to 4, the automatic setting device A starts a setting of magnitudes and directions of the propulsion forces that are generated by the propulsion units 12A1 and 13A1 and the steering actuators 12A2 and 13A2 (a setting of the control device 14) on the basis of, for example, the target behavior of the ship 1 ("turning clockwise on the spot," "turning counterclockwise on the spot," "rightward translational movement," "right-forward translational movement," "right-backward translational movement," "leftward translational movement," "left-forward translational movement," "left-backward translational movement," "forward movement," and "backward movement") input to the automatic setting device A by the user of the automatic setting device A.

Figure 5:
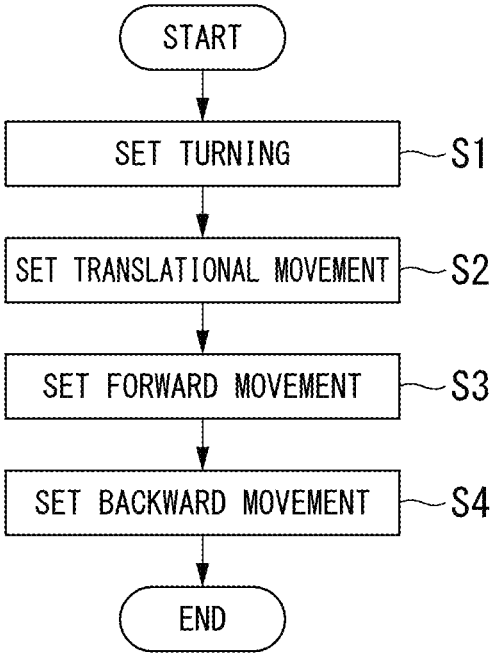
FIG. 5 is a diagram showing an example of a main routine of a process executed by the automatic setting device of the first embodiment.
Figure 6:
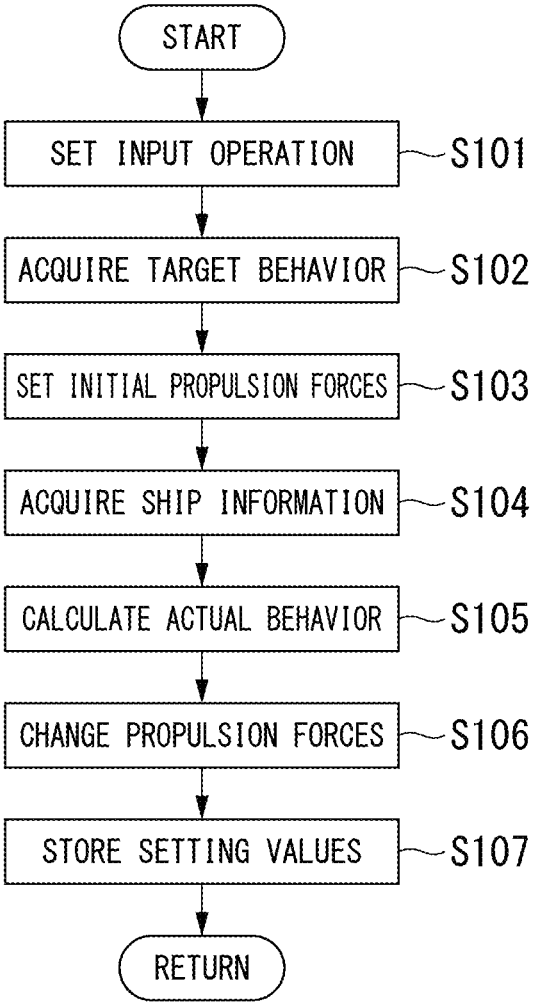
FIG. 6 is a diagram showing an example of a subroutine of the process executed by the automatic setting device of the first embodiment.

FIG. 5 is a diagram showing an example of a main routine of a process executed by the automatic setting device A of the first embodiment. FIG. 6 is a diagram showing an example of a subroutine of the process executed by the automatic setting device A of the first embodiment.

In a first example shown in FIGS. 5 and 6, in step S1 of FIG. 5, the automatic setting device A performs a setting of magnitudes and directions of the propulsion forces that are generated by the propulsion units 12A1 and 13A1 and the steering actuators 12A2 and 13A2 (a setting of the control device 14) when the ship 1 is turned clockwise on the spot and a setting of magnitudes and directions of the propulsion forces that are generated by the propulsion units 12A1 and 13A1 and the steering actuators 12A2 and 13A2 (a setting of the control device 14) when the ship 1 is turned counterclockwise on the spot.

Specifically, first, in step S101 of FIG. 6, the input operation setting unit A1 sets an input operation for rotating the lever clockwise around the central axis of the lever of the operation unit 11D as an input operation on the operation unit 11D so that the setting of the magnitudes and the directions of the propulsion forces that are generated by the propulsion units 12A1 and 13A1 and the steering actuators 12A2 and 13A2 (the setting of the control device 14) when the ship 1 is turned clockwise on the spot is performed.

Subsequently, in step S102, the target behavior acquisition unit A2 acquires "turning clockwise on the spot" as the target behavior of the ship 1 corresponding to the input operation set in step S101 (the input operation for rotating the lever clockwise around the central axis of the lever of the operation unit 11D).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for rotating the lever clockwise around the central axis of the lever of the operation unit 11D is set in step S101.

For example, the initial propulsion force setting unit A51 sets the magnitude of the initial propulsion force that is generated by the ship propulsion device 12 to a maximum value, sets the backward direction of the ship 1 as the direction of the initial propulsion force that is generated by the ship propulsion device 12, sets the magnitude of the initial propulsion force that is generated by the ship propulsion device 13 to a maximum value, and sets the forward direction of the ship 1 as the direction of the initial propulsion force that is generated by the ship propulsion device 13.

Subsequently, the ship propulsion devices 12 and 13 generate the initial propulsion forces set in step S103. As a result, the ship 1 starts a movement.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a current position of the ship 1 detected by the ship position detection unit 11E and the ship bow direction information acquisition unit A32 acquires information (ship information) about a current direction of the bow 1B of the ship 1 detected by the ship bow direction detection unit 11F.

In another example, in step S104, the ship position information acquisition unit A31 of the ship information acquisition unit A3 may acquire the information about the current position of the ship 1 detected by the ship position detection unit 11E and the information (ship information) about the past position of the ship 1 detected by the ship position detection unit 11E and stored in, for example, the storage unit of the ship 1, and the like and the ship bow direction information acquisition unit A32 may acquire the information about the current direction of the bow 1B of the ship 1 detected by the ship bow direction detection unit 11F and the information (ship information) about the past direction of the bow 1B of the ship 1 detected by the ship bow direction detection unit 11F and stored in, for example, the storage unit of the ship 1, and the like.

In the example shown in FIG. 6, subsequently, in step S105, the actual behavior calculation unit A4 calculates the actual behavior of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior of the ship 1 calculated in step S105 approaches the target behavior of the ship 1 acquired in step S102.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 (for example, the direction of the propulsion force generated by the ship propulsion device 12 is the backward direction of the ship 1 and the direction of the propulsion force generated by the ship propulsion device 13 is the forward direction of the ship 1) when the actual behavior of the ship 1 is within the allowable range of the target behavior of the ship 1 ("turning clockwise on the spot) as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 is turned clockwise on the spot is completed.

In the first example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("turning clockwise on the spot") as the magnitudes and the directions of the propulsion forces (the propulsion force setting values) that are generated by the propulsion units 12A1 and 13A1 and the steering actuators 12A2 and 13A2 when the ship 1 is turned counterclockwise on the spot.

As a result, a setting of the magnitudes and the directions of the propulsion forces that are generated by the propulsion units 12A1 and 13A1 and the steering actuators 12A2 and 13A2 (a setting of the control device 14) when the ship 1 is turned counterclockwise on the spot is completed.

In the first example shown in FIGS. 5 and 6 as described above, the ship 1 does not actually turn counterclockwise on the spot and a setting of the magnitudes and the directions of the propulsion forces that are generated by the propulsion units 12A1 and 13A1 and the steering actuators 12A2 and 13A2 (a setting of the control device 14) when the ship 1 is turned counterclockwise on the spot is performed. In another example, as the setting of the magnitudes and the directions of the propulsion forces that are generated by the propulsion units 12A1 and 13A1 and the steering actuators 12A2 and 13A2 (a setting of the control device 14) when the ship 1 is turned clockwise on the spot, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 is turned counterclockwise on the spot by causing the ship 1 to actually turn counterclockwise on the spot (i.e., on the basis of the actual behavior of the ship 1).

In the first example shown in FIGS. 5 and 6, subsequently, in step S2 of FIG. 5, the automatic setting device A performs a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction, and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction.

Specifically, first, in step S101 of FIG. 6, for example, the input operation setting unit A1 sets an input operation for moving the tip of the lever of the operation unit 11D from the position P1 to the position P2 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction is performed.

Subsequently, in step S102, the target behavior acquisition unit A2 acquires "rightward translational movement" as the target behavior of the ship 1 corresponding to the input operation set in step S101 (the input operation for moving the tip of the lever of the operation unit 11D from the position P1 to the position P2).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) (for example, sets the backward direction of the ship 1 as the direction of the propulsion force generated by the ship propulsion device 12 and sets the forward direction of the ship 1 as the direction of the propulsion force generated by the ship propulsion device 13) after the input operation for moving the tip of the lever of the operation unit 11D from the position P1 to the position P2 is set in step S101.

For example, the initial propulsion force setting unit A51 sets the magnitudes and the directions of the propulsion forces that are generated by the ship propulsion devices 12 and 13 when the ship 1 is turned clockwise on the spot stored as the propulsion force setting values in step S107 of FIG. 6 during the execution of step S1 of FIG. 5 as the magnitudes and the directions of the initial propulsion forces.

Next, the ship propulsion devices 12 and 13 generate the initial propulsion forces set in step S103. As a result, the ship 1 turns clockwise on the spot.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior ("turning clockwise on the spot") of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior ("turning clockwise on the spot") of the ship 1 calculated in step S105 approaches the target behavior ("rightward translational movement") of the ship 1 acquired in step S102.

For example, the propulsion force change unit A52 changes the direction of the propulsion force generated by the ship propulsion device 12 from the backward direction to the right-backward direction of the ship 1 and changes the direction of the propulsion force generated by the ship propulsion device 13 from the forward direction to the right-forward direction of the ship 1.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior ("rightward translational movement") of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("rightward translational movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 performs the translational movement in the right direction is completed.

In the first example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("rightward translational movement") as the magnitudes and the directions of the propulsion forces (the propulsion force setting values) that are generated by the propulsion units 12A1 and 13A1 and the steering actuators 12A2 and 13A2 when the ship 1 performs the translational movement in the left direction.

As a result, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction is completed.

In the first example shown in FIGS. 5 and 6 as described above, the ship 1 does not actually perform a translational movement in the left direction and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction is performed. In another example, as the setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction by causing the ship 1 to actually perform a translational movement in the left direction (i.e., on the basis of the actual behavior of the ship 1).

In the first example shown in FIGS. 5 and 6, subsequently, for example, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction is executed in the automatic setting device A.

Specifically, first, in step S101 of FIG. 6, for example, the input operation setting unit A1 sets an input operation for moving the tip of the lever of the operation unit 11D from the position P1 to the position P3 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction is performed.

Subsequently, in step S102, the target behavior acquisition unit A2 acquires "right-forward translational movement" as the target behavior of the ship 1 corresponding to the input operation set in step S101 (the input operation for moving the tip of the lever of the operation unit 11D from the position P1 to the position P3).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for moving the tip of the lever of the operation unit 11D from the position P1 to the position P3 is set in step S101.

For example, the initial propulsion force setting unit A51 sets magnitudes and directions of the propulsion forces generated by the ship propulsion devices 12 and 13 when the ship 1 is performing a translational movement in the right direction stored as the propulsion force setting values in step S107 of FIG. 6, which was executed previously, as the magnitudes and the directions of the initial propulsion forces.

Next, the ship propulsion devices 12 and 13 generate the initial propulsion forces set in step S103. As a result, the ship 1 performs a translational movement in the right direction.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior of the ship 1 ("rightward translational movement") on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior ("rightward translational movement") of the ship 1 calculated in step S105 approaches the target behavior ("right-forward translational movement") of the ship 1 acquired in step S102.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior ("right-forward translational movement") of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("right-forward translational movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 performs the translational movement in the right-forward direction is completed.

In the first example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("right-forward translational movement") as the magnitudes and the directions of the propulsion forces (the propulsion force setting values) that are generated by the propulsion units 12A1 and 13A1 and the steering actuators 12A2 and 13A2 when the ship 1 performs the translational movement in the left-forward direction.

As a result, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction is completed.

In the first example shown in FIGS. 5 and 6 as described above, the ship 1 does not actually perform a translational movement in the left-forward direction and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction is performed. In another example, as the setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction by causing the ship 1 to actually perform a translational movement in the left-forward direction (i.e., on the basis of the actual behavior of the ship 1).

In the first example shown in FIGS. 5 and 6, subsequently, for example, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction is executed in the automatic setting device A.

Specifically, first, in step S101 of FIG. 6, for example, the input operation setting unit A1 sets an input operation for moving the tip of the lever of the operation unit 11D from the position P1 to the position P4 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction is performed.

Subsequently, in step S102, the target behavior acquisition unit A2 acquires "right-backward translational movement" as the target behavior of the ship 1 corresponding to the input operation set in step S101 (the input operation for moving the tip of the lever of the operation unit 11D from the position P1 to the position P4).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for moving the tip of the lever of the operation unit 11D from the position P1 to the position P4 is set in step S101.

For example, the initial propulsion force setting unit A51 sets magnitudes and directions of the propulsion forces generated by the ship propulsion devices 12 and 13 when the ship 1 is performing a translational movement in the right direction stored as the propulsion force setting values in step S107 of FIG. 6, which was executed in the time before the last process, as the magnitudes and the directions of the initial propulsion forces.

Next, the ship propulsion devices 12 and 13 generate the initial propulsion forces set in step S103. As a result, the ship 1 performs a translational movement in the right direction.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior ("rightward translational movement") of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior ("rightward translational movement") of the ship 1 calculated in step S105 approaches the target behavior ("right-backward translational movement") of the ship 1 acquired in step S102.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior ("right-backward translational movement") of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("right-backward translational movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 performs the translational movement in the right-backward direction is completed.

In the first example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("right-backward translational movement") as the magnitudes and the directions of the propulsion forces (the propulsion force setting values) that are generated by the propulsion units 12A1 and 13A1 and the steering actuators 12A2 and 13A2 when the ship 1 performs the translational movement in the left-backward direction.

As a result, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction is completed.

In the first example shown in FIGS. 5 and 6 as described above, the ship 1 does not actually perform a translational movement in the left-backward direction and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction is performed. In another example, as the setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction by causing the ship 1 to actually perform a translational movement in the left-backward direction (i.e., on the basis of the actual behavior of the ship 1).

In the first example shown in FIGS. 5 and 6, subsequently, in step S3 of FIG. 5, a setting of the magnitudes and the directions of the propulsion forces that are generated by the propulsion units 12A1 and 13A1 and the steering actuators 12A2 and 13A2 (a setting of the control device 14) when the ship 1 is moved forward is executed in the automatic setting device A.

Specifically, first, in step S101 of FIG. 6, for example, the input operation setting unit A1 sets an input operation for moving the tip of the lever of the operation unit 11D from the position P1 to the position P8 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 is moved forward is performed.

Subsequently, in step S102, the target behavior acquisition unit A2 acquires "forward movement" as the target behavior of the ship 1 corresponding to the input operation set in step S101 (the input operation for moving the tip of the lever of the operation unit 11D from the position P1 to the position P8).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for moving the tip of the lever of the operation unit 11D from the position P1 to the position P8 is set in step S101.

For example, the initial propulsion force setting unit A51 sets the magnitude of the initial propulsion force that is generated by the ship propulsion device 12 to a maximum value, sets the forward direction of the ship 1 as the direction of the initial propulsion force that is generated by the ship propulsion device 12, sets the magnitude of the initial propulsion force that is generated by the ship propulsion device 13 to a maximum value, and sets the forward direction of the ship 1 as the direction of the initial propulsion force that is generated by the ship propulsion device 13.

Next, the ship propulsion devices 12 and 13 generate the initial propulsion forces set in step S103. As a result, the ship 1 performs a forward movement.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior of the ship 1 calculated in step S105 approaches the target behavior of the ship 1 acquired in step S102 (for example, decreases the magnitude of the forward propulsion force generated by the ship propulsion device 12 to an appropriate value and decreases the magnitude of the forward propulsion force generated by the ship propulsion device 13 to an appropriate value).

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("forward movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 is moved forward is completed.

In the first example shown in FIGS. 5 and 6, subsequently, in step S4 of FIG. 5, a setting of the magnitudes and the directions of the propulsion forces that are generated by the propulsion units 12A1 and 13A1 and the steering actuators 12A2 and 13A2 (a setting of the control device 14) when the ship 1 is moved backward is executed in the automatic setting device A.

Specifically, first, in step S101 of FIG. 6, for example, the input operation setting unit A1 sets an input operation for moving the tip of the lever of the operation unit 11D from the position P1 to the position P9 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 is moved backward is performed.

Subsequently, in step S102, the target behavior acquisition unit A2 acquires "backward movement" as the target behavior of the ship 1 corresponding to the input operation set in step S101 (the input operation for moving the tip of the lever of the operation unit 11D from the position P1 to the position P9).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for moving the tip of the lever of the operation unit 11D from the position P1 to the position P9 is set in step S101.

For example, the initial propulsion force setting unit A51 sets the magnitude of the initial propulsion force that is generated by the ship propulsion device 12 to a maximum value, sets the backward direction of the ship 1 as the direction of the initial propulsion force that is generated by the ship propulsion device 12, sets the magnitude of the initial propulsion force that is generated by the ship propulsion device 13 to a maximum value, and sets the backward direction of the ship 1 as the direction of the initial propulsion force that is generated by the ship propulsion device 13.

Next, the ship propulsion devices 12 and 13 generate the initial propulsion forces set in step S103. As a result, the ship 1 performs a backward movement.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior of the ship 1 calculated in step S105 approaches the target behavior of the ship 1 acquired in step S102 (for example, decreases the magnitude of the backward propulsion force generated by the ship propulsion device 12 to an appropriate value and decreases the magnitude of the backward propulsion force generated by the ship propulsion device 13 to an appropriate value).

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("backward movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 is moved backward is completed.

In the first example shown in FIGS. 5 and 6, as described above, for example, a setting of the control device 14 for implementing the target behavior ("turning clockwise on the spot," "turning counterclockwise on the spot," "rightward translational movement," "right-forward translational movement," "right-backward translational movement," "leftward translational movement," "left-forward translational movement," "left-backward translational movement," "forward movement," and "backward movement") of the ship 1 input to the automatic setting device A by the user of the automatic setting device A is completed.

As described above, in the automatic setting device A of the first embodiment, a process of changing the propulsion forces that are generated by the ship propulsion devices 12 and 13 is executed so that the actual behavior of the ship 1 approaches the target behavior of the ship 1. That is, according to the automatic setting device A of the first embodiment, the worker does not have to perform all the work of changing the propulsion forces that are generated by the ship propulsion devices 12 and 13 so that the actual behavior of the ship 1 approaches the target behavior of the ship 1.

Also, in the automatic setting device A of the first embodiment, a process of storing the propulsion forces that are generated by the ship propulsion devices 12 and 13 when the actual behavior of the ship 1 is within the allowable range of the target behavior of the ship 1 is executed. That is, it is not necessary for the worker to store the propulsion forces that are generated by the ship propulsion devices 12 and 13 in a computer or the like when the actual behavior of the ship 1 is within the allowable range of the target behavior of the ship 1.

That is, all the setting of the control device 14 for the ship propulsion devices 12 and 13 is not performed in the work of the worker, but is performed in the process of the automatic setting device A.

As a result, the setting of the control device 14 for the ship propulsion devices 12 and 13 can be automatically performed without the need for the worker to perform all the setting work associated with the control device 14 for the ship propulsion devices 12 and 13.

Also, it is possible to limit variations in setting of a plurality of control devices 14 as compared with the case where the setting of the plurality of control devices 14 are performed by a plurality of workers.

Also, in the first example of the automatic setting device A of the first embodiment, after the setting value storage unit A53 of the propulsion force setting unit A5 stores the magnitudes and the directions of the propulsion forces that are generated by the ship propulsion devices 12 and 13 when the ship 1 is turning clockwise on the spot as propulsion force setting values, the input operation setting unit A1 sets an input operation for causing the ship 1 to perform a translational movement in the right direction as an input operation for the ship 1 and the initial propulsion force setting unit A51 of the propulsion force setting unit A5 sets the magnitudes and the directions of the propulsion forces that are generated by the ship propulsion devices 12 and 13 when the ship 1 is turning clockwise on the spot stored as the propulsion force setting values by the setting value storage unit A53 as the magnitudes and the directions of the initial propulsion forces.

Thus, in the first example of the automatic setting device A of the first embodiment, the magnitudes and the directions of the propulsion forces that are generated by the ship propulsion devices 12 and 13 when the ship 1 is turning clockwise on the spot may be used as they are as the magnitudes and the directions of the initial propulsion forces for implementing the rightward translational movement of the ship 1.

Also, in another example of the automatic setting device A of the first embodiment, after the setting value storage unit A53 of the propulsion force setting unit A5 stores the magnitudes and the directions of the propulsion forces that are generated by the ship propulsion devices 12 and 13 when the ship 1 is turning clockwise on the spot as propulsion force setting values, the input operation setting unit A1 may set an input operation for causing the ship 1 to perform a translational movement in the right-forward direction as an input operation for the ship 1 and the initial propulsion force setting unit A51 of the propulsion force setting unit A5 may set the magnitudes and the directions of the propulsion forces that are generated by the ship propulsion devices 12 and 13 when the ship 1 is turning clockwise on the spot stored as the propulsion force setting values by the setting value storage unit A53 as the magnitudes and the directions of the initial propulsion forces.

Also, in yet another example of the automatic setting device A of the first embodiment, after the setting value storage unit A53 of the propulsion force setting unit A5 stores the magnitudes and the directions of the propulsion forces that are generated by the ship propulsion devices 12 and 13 when the ship 1 is turning clockwise on the spot as propulsion force setting values, the input operation setting unit A1 may set an input operation for causing the ship 1 to perform a translational movement in the right-backward direction as an input operation for the ship 1 and the initial propulsion force setting unit A51 of the propulsion force setting unit A5 may set the magnitudes and the directions of the propulsion forces that are generated by the ship propulsion devices 12 and 13 when the ship 1 is turning clockwise on the spot stored as the propulsion force setting values by the setting value storage unit A53 as the magnitudes and the directions of the initial propulsion forces.

Although the automatic setting device A initially performs a setting of magnitudes and directions of the propulsion forces that are generated by the propulsion units 12A1 and 13A1 and the steering actuators 12A2 and 13A2 when the ship 1 is turned clockwise on the spot (a setting of the control device 14) in the first example of the automatic setting device A of the first embodiment described above, the automatic setting device A initially performs a setting of magnitudes and directions of the propulsion forces that are generated by the propulsion units 12A1 and 13A1 and the steering actuators 12A2 and 13A2 when the ship 1 is turned counterclockwise on the spot (a setting of the control device 14) in a second example of the automatic setting device A of the first embodiment to be described below.

In the second example of the automatic setting device A of the first embodiment, as in the first example of the automatic setting device A of the first embodiment described above, in step S1 of FIG. 5, the automatic setting device A performs a setting of magnitudes and directions of the propulsion forces that are generated by the propulsion units 12A1 and 13A1 and the steering actuators 12A2 and 13A2 (a setting of the control device 14) when the ship 1 is turned clockwise on the spot and a setting of magnitudes and directions of the propulsion forces that are generated by the propulsion units 12A1 and 13A1 and the steering actuators 12A2 and 13A2 (a setting of the control device 14) when the ship 1 is turned counterclockwise on the spot.

Specifically, first, in step S101 of FIG. 6, the input operation setting unit A1 sets an input operation for rotating the lever counterclockwise around the central axis of the lever of the operation unit 11D as an input operation on the operation unit 11D so that the setting of the magnitudes and the directions of the propulsion forces that are generated by the propulsion units 12A1 and 13A1 and the steering actuators 12A2 and 13A2 (the setting of the control device 14) when the ship 1 is turned counterclockwise on the spot is performed.

Subsequently, in step S102, the target behavior acquisition unit A2 acquires "turning counterclockwise on the spot" as the target behavior of the ship 1 corresponding to the input operation set in step S101 (the input operation for rotating the lever counterclockwise around the central axis of the lever of the operation unit 11D).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for rotating the lever counterclockwise around the central axis of the lever of the operation unit 11D is set in step S101.

For example, the initial propulsion force setting unit A51 sets the magnitude of the initial propulsion force that is generated by the ship propulsion device 12 to a maximum value, sets the forward direction of the ship 1 as the direction of the initial propulsion force that is generated by the ship propulsion device 12, sets the magnitude of the initial propulsion force that is generated by the ship propulsion device 13 to a maximum value, and sets the backward direction of the ship 1 as the direction of the initial propulsion force that is generated by the ship propulsion device 13.

Subsequently, the ship propulsion devices 12 and 13 generate the initial propulsion forces set in step S103. As a result, the ship 1 starts a movement.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior of the ship 1 calculated in step S105 approaches the target behavior of the ship 1 acquired in step S102.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 (for example, the direction of the propulsion force generated by the ship propulsion device 12 is the forward direction of the ship 1 and the direction of the propulsion force generated by the ship propulsion device 13 is the backward direction of the ship 1) when the actual behavior of the ship 1 is within the allowable range of the target behavior of the ship 1 ("turning counterclockwise on the spot) as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 is turned counterclockwise on the spot is completed.

In the second example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("turning counterclockwise on the spot") as the magnitudes and the directions of the propulsion forces (the propulsion force setting values) that are generated by the propulsion units 12A1 and 13A1 and the steering actuators 12A2 and 13A2 when the ship 1 is turned clockwise on the spot.

As a result, a setting of the magnitudes and the directions of the propulsion forces that are generated by the propulsion units 12A1 and 13A1 and the steering actuators 12A2 and 13A2 (a setting of the control device 14) when the ship 1 is turned clockwise on the spot is completed.

In the second example shown in FIGS. 5 and 6 as described above, the ship 1 does not actually turn clockwise on the spot and a setting of the magnitudes and the directions of the propulsion forces that are generated by the propulsion units 12A1 and 13A1 and the steering actuators 12A2 and 13A2 (a setting of the control device 14) when the ship 1 is turned clockwise on the spot is performed. In another example, as the setting of the magnitudes and the directions of the propulsion forces that are generated by the propulsion units 12A1 and 13A1 and the steering actuators 12A2 and 13A2 (a setting of the control device 14) when the ship 1 is turned counterclockwise on the spot, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 is turned clockwise on the spot by causing the ship 1 to actually turn clockwise on the spot (i.e., on the basis of the actual behavior of the ship 1).

In the second example shown in FIGS. 5 and 6, subsequently, in step S2 of FIG. 5, the automatic setting device A performs a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction, and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction.

Specifically, first, in step S101 of FIG. 6, for example, the input operation setting unit A1 sets an input operation for moving the tip of the lever of the operation unit 11D from the position P1 to the position P5 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction is performed.

Subsequently, in step S102, the target behavior acquisition unit A2 acquires "leftward translational movement" as the target behavior of the ship 1 corresponding to the input operation set in step S101 (the input operation for moving the tip of the lever of the operation unit 11D from the position P1 to the position P5).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) (for example, sets the forward direction of the ship 1 as the direction of the propulsion force generated by the ship propulsion device 12 and sets the backward direction of the ship 1 as the direction of the propulsion force generated by the ship propulsion device 13) after the input operation for moving the tip of the lever of the operation unit 11D from the position P1 to the position P5 is set in step S101.

For example, the initial propulsion force setting unit A51 sets the magnitudes and the directions of the propulsion forces that are generated by the ship propulsion devices 12 and 13 when the ship 1 is turned counterclockwise on the spot stored as the propulsion force setting values in step S107 of FIG. 6 during the execution of step S1 of FIG. 5 as the magnitudes and the directions of the initial propulsion forces.

Next, the ship propulsion devices 12 and 13 generate the initial propulsion forces set in step S103. As a result, the ship 1 turns counterclockwise on the spot.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior ("turning counterclockwise on the spot") of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior ("turning counterclockwise on the spot") of the ship 1 calculated in step S105 approaches the target behavior ("leftward translational movement") of the ship 1 acquired in step S102.

For example, the propulsion force change unit A52 changes the direction of the propulsion force generated by the ship propulsion device 12 from the forward direction to the left-forward direction of the ship 1 and changes the direction of the propulsion force generated by the ship propulsion device 13 from the backward direction to the left-backward direction of the ship 1.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior ("leftward translational movement") of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("leftward translational movement") of the ship 1 as the propulsion force set values.

As a result, a setting of the magnitudes and the directions of the propulsion forces that are generated by the propulsion units 12A1 and 13A1 and the steering actuators 12A2 and 13A2 (a setting of the control device 14) when the ship 1 performs the translational movement in the left direction is completed.

In the second example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("leftward translational movement") as the magnitudes and the directions of the propulsion forces (the propulsion force setting values) that are generated by the propulsion units 12A1 and 13A1 and the steering actuators 12A2 and 13A2 when the ship 1 performs the translational movement in the right direction.

As a result, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction is completed.

In the second example shown in FIGS. 5 and 6 as described above, the ship 1 does not actually perform a translational movement in the right direction and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction is performed. In another example, as the setting of the magnitudes and the directions of the propulsion forces that are generated by the propulsion units 12A1 and 13A1 and the steering actuators 12A2 and 13A2 (a setting of the control device 14) when the ship 1 performs a translational movement in the left direction, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right direction by causing the ship 1 to actually perform a translational movement in the right direction (i.e., on the basis of the actual behavior of the ship 1).

In the second example shown in FIGS. 5 and 6, subsequently, for example, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction is executed in the automatic setting device A.

Specifically, first, in step S101 of FIG. 6, for example, the input operation setting unit A1 sets an input operation for moving the tip of the lever of the operation unit 11D from the position P1 to the position P6 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction is performed.

Subsequently, in step S102, the target behavior acquisition unit A2 acquires "left-forward translational movement" as the target behavior of the ship 1 corresponding to the input operation set in step S101 (the input operation for moving the tip of the lever of the operation unit 11D from the position P1 to the position P6).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for moving the tip of the lever of the operation unit 11D from the position P1 to the position P6 is set in step S101.

For example, the initial propulsion force setting unit A51 sets magnitudes and directions of the propulsion forces generated by the ship propulsion devices 12 and 13 when the ship 1 is performing a translational movement in the left direction stored as the propulsion force setting values in step S107 of FIG. 6, which was executed previously, as the magnitudes and the directions of the initial propulsion forces.

Next, the ship propulsion devices 12 and 13 generate the initial propulsion forces set in step S103. As a result, the ship 1 performs a translational movement in the left direction.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior of the ship 1 ("leftward translational movement") on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior ("leftward translational movement") of the ship 1 calculated in step S105 approaches the target behavior ("left-forward translational movement") of the ship 1 acquired in step S102.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior ("left-forward translational movement") of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("left-forward translational movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 performs the translational movement in the left-forward direction is completed.

In the second example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("left-forward translational movement") as the magnitudes and the directions of the propulsion forces (the propulsion force setting values) that are generated by the propulsion units 12A1 and 13A1 and the steering actuators 12A2 and 13A2 when the ship 1 performs the translational movement in the right-forward direction.

As a result, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction is completed.

In the second example shown in FIGS. 5 and 6 as described above, the ship 1 does not actually perform a translational movement in the right-forward direction and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction is performed. In another example, as the setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-forward direction, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-forward direction by causing the ship 1 to actually perform a translational movement in the right-forward direction (i.e., on the basis of the actual behavior of the ship 1).

In the second example shown in FIGS. 5 and 6, subsequently, for example, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction is executed in the automatic setting device A.

Specifically, first, in step S101 of FIG. 6, for example, the input operation setting unit A1 sets an input operation for moving the tip of the lever of the operation unit 11D from the position P1 to the position P7 as an input operation on the operation unit 11D so that a setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction is performed.

Subsequently, in step S102, the target behavior acquisition unit A2 acquires "left-backward translational movement" as the target behavior of the ship 1 corresponding to the input operation set in step S101 (the input operation for moving the tip of the lever of the operation unit 11D from the position P1 to the position P7).

Subsequently, in step S103, the initial propulsion force setting unit A51 of the propulsion force setting unit A5 sets the magnitudes and the directions of the propulsion forces that are initially generated by the propulsion units 12A1 and 13A1 and the steering actuators 12A2 and 13A2 (the magnitudes and the directions of the initial propulsion forces) after the input operation for moving the tip of the lever of the operation unit 11D from the position P1 to the position P7 is set in step S101.

For example, the initial propulsion force setting unit A51 sets magnitudes and directions of the propulsion forces generated by the ship propulsion devices 12 and 13 when the ship 1 is performing a translational movement in the left direction stored as the propulsion force setting values in step S107 of FIG. 6, which was executed in the time before the last process, as the magnitudes and the directions of the initial propulsion forces.

Next, the ship propulsion devices 12 and 13 generate the initial propulsion forces set in step S103. As a result, the ship 1 performs a translational movement in the left direction.

Subsequently, the ship position detection unit 11E of the ship 1 detects a position of the ship 1 and the ship bow direction detection unit 11F detects a direction of the bow 1B of the ship 1.

Subsequently, in step S104, the ship position information acquisition unit A31 of the ship information acquisition unit A3 acquires information (ship information) about a position of the ship 1 detected by the ship position detection unit 11E and the ship bow direction information acquisition unit A32 acquires information (ship information) about a direction of the bow 1B of the ship 1 detected by the ship bow direction detection unit 11F.

Subsequently, in step S105, the actual behavior calculation unit A4 calculates the actual behavior ("leftward translational movement") of the ship 1 on the basis of the ship information acquired in step S104.

Subsequently, in step S106, the propulsion force change unit A52 of the propulsion force setting unit A5 changes at least one of the magnitudes and the directions of the propulsion forces that are generated by the propulsion units 12A1 and 13A1 and the steering actuators 12A2 and 13A2 from the magnitudes and the directions of the initial propulsion forces set by the initial propulsion force setting unit A51 so that the actual behavior ("leftward translational movement") of the ship 1 calculated in step S105 approaches the target behavior ("left-backward translational movement") of the ship 1 acquired in step S102.

Next, the ship propulsion devices 12 and 13 generate the propulsion forces changed by the propulsion force change unit A52. As a result, the actual behavior of the ship 1 changes.

The change in the propulsion force in step S106 is repeated until the actual behavior of the ship 1 is within the allowable range of the target behavior ("left-backward translational movement") of the ship 1.

In another example, the automatic setting device A does not execute step S106, and the worker (for example, the user of the automatic setting device A) may perform a process corresponding to step S106 (a process of changing at least one of the magnitude and the direction of the propulsion force so that the actual behavior of the ship 1 approaches the target behavior of the ship 1).

In the example shown in FIG. 6, subsequently, in step S107, the setting value storage unit A53 of the propulsion force setting unit A5 stores the magnitudes and the directions of the propulsion forces that are generated by the propulsion units 12A1 and 13A1 and the steering actuators 12A2 and 13A2 when the actual behavior of the ship 1 is within the allowable range of the target behavior ("left-backward translational movement") of the ship 1 as the propulsion force setting values.

As a result, a setting of the magnitudes and the directions of the propulsion forces that are generated by the propulsion units 12A1 and 13A1 and the steering actuators 12A2 and 13A2 (a setting of the control device 14) when the ship 1 performs the translational movement in the left-backward direction is completed.

In the second example shown in FIGS. 5 and 6, subsequently, the setting value storage unit A53 stores results of performing a left-right reversal process (a mirror image reversal process) on the magnitudes and the directions of the propulsion forces that are generated by the propulsion units 12A1 and 13A1 and the steering actuators 12A2 and 13A2 when the actual behavior of the ship 1 is within the allowable range of the target behavior of the ship 1 ("left-backward translational movement") as the magnitudes and the directions of the propulsion forces (the propulsion force setting values) that are generated by the propulsion units 12A1 and 13A1 and the steering actuators 12A2 and 13A2 when the ship 1 performs the translational movement in the right-backward direction.

As a result, a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction is completed.

In the second example shown in FIGS. 5 and 6 as described above, the ship 1 does not actually perform a translational movement in the right-backward direction and a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction is performed. In another example, as the setting of the magnitudes and the directions of the propulsion forces that are generated by the propulsion units 12A1 and 13A1 and the steering actuators 12A2 and 13A2 (a setting of the control device 14) when the ship 1 performs a translational movement in the left-backward direction, the automatic setting device A may perform a setting of the magnitudes and the directions of the propulsion forces that are generated by the propulsion units 12A1 and 13A1 and the steering actuators 12A2 and 13A2 (a setting of the control device 14) when the ship 1 performs a translational movement in the right-backward direction by causing the ship 1 to actually perform a translational movement in the right-backward direction (i.e., on the basis of the actual behavior of the ship 1).

In the second example shown in FIG. 5 and FIG. 6, as in the first example shown in FIG. 5 and FIG. 6, subsequently, in step S3 of FIG. 5, the automatic setting device A performs a setting of the magnitudes and the directions of the propulsion forces that are generated by the propulsion units 12A1 and 13A1 and the steering actuators 12A2 and 13A2 (a setting of the control device 14) when the ship 1 is moved forward.

In the second example shown in FIGS. 5 and 6, as in the first example shown in FIG. 5 and FIG. 6, subsequently, in step S4 of FIG. 5, the automatic setting device A performs a setting of the magnitudes and the directions of the propulsion forces that are generated by the propulsion units 12A1 and 13A1 and the steering actuators 12A2 and 13A2 (a setting of the control device 14) when the ship 1 is moved backward.

In the second example shown in FIGS. 5 and 6, as described above, for example, a setting of the control device 14 for implementing the target behavior ("turning clockwise on the spot," "turning counterclockwise on the spot," "rightward translational movement," "right-forward translational movement," "right-backward translational movement," "leftward translational movement," "left-forward translational movement," "left-backward translational movement," "forward movement," and "backward movement") of the ship 1 input to the automatic setting device A by the user of the automatic setting device A is completed.

Also, in the second example of the automatic setting device A of the first embodiment, after the setting value storage unit A53 of the propulsion force setting unit A5 stores the magnitudes and the directions of the propulsion forces that are generated by the ship propulsion devices 12 and 13 when the ship 1 is turning counterclockwise on the spot as propulsion force setting values, the input operation setting unit A1 sets an input operation for causing the ship 1 to perform a translational movement in the left direction as an input operation for the ship 1 and the initial propulsion force setting unit A51 of the propulsion force setting unit A5 sets the magnitudes and the directions of the propulsion forces that are generated by the ship propulsion devices 12 and 13 when the ship 1 is turning counterclockwise on the spot stored as the propulsion force setting values by the setting value storage unit A53 as the magnitudes and the directions of the initial propulsion forces.

Thus, in the second example of the automatic setting device A of the first embodiment, the magnitudes and the directions of the propulsion forces that are generated by the ship propulsion devices 12 and 13 when the ship 1 is turning counterclockwise on the spot may be used as they are as the magnitudes and the directions of the initial propulsion forces for implementing the leftward translational movement of the ship 1.

Also, in another example of the automatic setting device A of the first embodiment, after the setting value storage unit A53 of the propulsion force setting unit A5 stores the magnitudes and the directions of the propulsion forces that are generated by the ship propulsion devices 12 and 13 when the ship 1 is turning counterclockwise on the spot as propulsion force setting values, the input operation setting unit A1 may set an input operation for causing the ship 1 to perform a translational movement in the left-forward direction as an input operation for the ship 1 and the initial propulsion force setting unit A51 of the propulsion force setting unit A5 may set the magnitudes and the directions of the propulsion forces that are generated by the ship propulsion devices 12 and 13 when the ship 1 is turning counterclockwise on the spot stored as the propulsion force setting values by the setting value storage unit A53 as the magnitudes and the directions of the initial propulsion forces.

Also, in yet another example of the automatic setting device A of the first embodiment, after the setting value storage unit A53 of the propulsion force setting unit A5 stores the magnitudes and the directions of the propulsion forces that are generated by the ship propulsion devices 12 and 13 when the ship 1 is turning counterclockwise on the spot as propulsion force setting values, the input operation setting unit A1 may set an input operation for causing the ship 1 to perform a translational movement in the left-backward direction as an input operation for the ship 1 and the initial propulsion force setting unit A51 of the propulsion force setting unit A5 may set the magnitudes and the directions of the propulsion forces that are generated by the ship propulsion devices 12 and 13 when the ship 1 is turning counterclockwise on the spot stored as the propulsion force setting values by the setting value storage unit A53 as the magnitudes and the directions of the initial propulsion forces.

Figure 7:
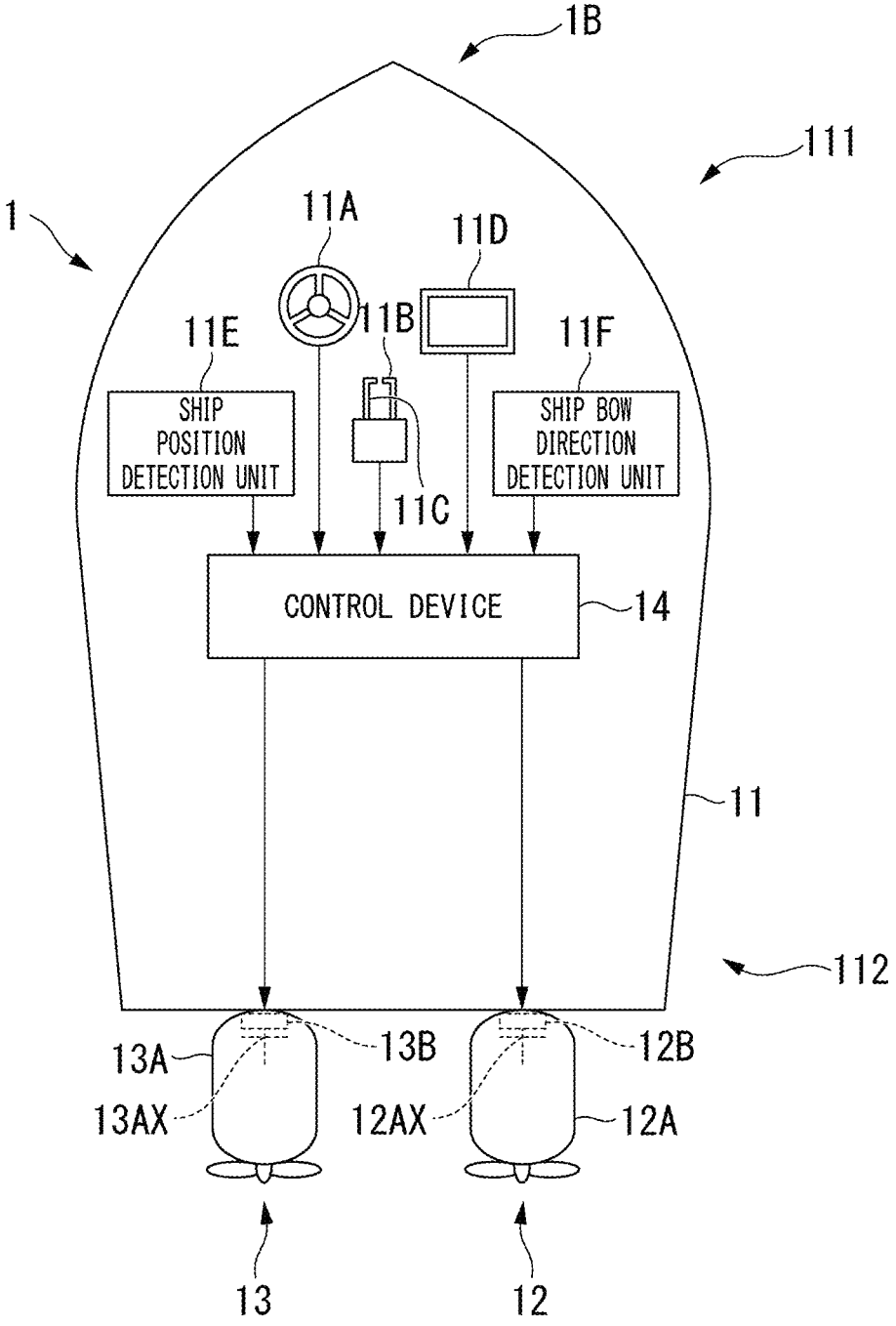
FIG. 7 is a diagram showing another example of a ship 1 having the control device which is set by the automatic setting device of the first embodiment.

FIG. 7 is a diagram showing another example of the ship 1 having the control device 14 which is set by the automatic setting device A of the first embodiment.

In the ship 1 shown in FIG. 1, the operation unit 11D includes a joystick having a lever.

On the other hand, in the ship 1 shown in FIG. 7, the operation unit 11D includes a touch panel. The ship operator can not only operate the propulsion units 12A1 and 13A1 and the steering actuators 12A2 and 13A2 by operating the steering device 11A (the steering wheel) and the remote control devices 11B and 11C (the remote control levers), but also operate the propulsion units 12A1 and 13A1 and the steering actuators 12A2 and 13A2 by operating the operation unit 11D (the touch panel).

In another example, the hull 11 may not include the steering device 11A, the remote control device 11B, and the remote control device 11C.

In the example shown in FIG. 7, the control device 14 controls the steering actuator 12A2 and the propulsion unit 12A1 of the ship propulsion device 12 and the steering actuator 13A2 and the propulsion unit 13A1 of the ship propulsion device 13 on the basis of an input operation on the operation unit 11D.

Specifically, the control device 14 controls the magnitudes and the directions of the propulsion forces for the ship 1 generated by the propulsion units 12A1 and 13A1 and the steering actuators 12A2 and 13A2 on the basis of, for example, a flick input operation to the operation unit 11D (a touch panel).

In the flick input operation, for example, the ship operator allows his/her finger pressing the touch panel to slide in a desired direction while pressing the touch panel.

A movement path calculation unit 14A calculates a movement path of the operation unit 11D. Specifically, the movement path calculation unit 14A calculates a movement path of the finger of the ship operator which slides while pressing the touch panel.

A propulsion force calculation unit 14B calculates magnitudes and directions of propulsion forces that are generated by the ship propulsion devices 12 and 13 on the basis of the movement path of the operation unit 11D calculated by the movement path calculation unit 14A (the movement path of the finger which slides while pressing the touch panel).

In the example shown in FIG. 7, the operation unit 11D is configured so that the flick input operation can be performed on the operation unit 11D (the touch panel) and a rotation input operation can be performed thereon.

For example, the ship operator performs the rotation input operation by allowing another finger of the ship operator to slide in a circumferential direction while pressing the touch panel in a state in which one finger of the ship operator comes into contact with the touch panel and fixed as a center point.

When the ship operator performs a clockwise rotation input operation on the operation unit 11D (the touch panel), the control device 14 controls the propulsion units 12A1 and 13A1 and the steering actuators 12A2 and 13A2 so that the ship 1 turns to the right. On the other hand, when the ship operator performs a counterclockwise rotation input operation on the operation unit 11D (the touch panel), the control device 14 controls the propulsion units 12A1 and 13A1 and the steering actuators 12A2 and 13A2 so that the ship 1 turns to the left.

Also, when the ship operator performs a flick input operation on the operation unit 11D (the touch panel), the control device 14 controls the propulsion units 12A1 and 13A1 and the steering actuators 12A2 and 13A2 so that the hull 11 moves (performs a translational movement) in a direction in which the ship operator's finger is allowed to slide while an attitude is maintained.

When the ship operator does not perform a flick input operation on the operation unit 11D (the touch panel) (i.e., when the ship operator's finger does not come into contact with the touch panel), the operation unit 11D is in a state similar to the state shown in (A) of FIG. 3A. As a result, the control device 14 does not cause the propulsion units 12A1 and 13A1 and the steering actuators 12A2 and 13A2 to generate the propulsion forces for the ship 1.

Second Embodiment

Before a second embodiment of an automatic setting device, an automatic setting method, and a program of the present invention is described, an example of a ship 1 having a control device 14 which is set by an automatic setting device A of the second embodiment will be described.

As described above, the ship 1 having the control device 14 which is set by the automatic setting device A of the first embodiment includes the two ship propulsion devices 12 and 13. On the other hand, the ship 1 having the control device 14 which is set by the automatic setting device A of the second embodiment includes three or more ship propulsion devices (not shown).

The automatic setting device A of the second embodiment is configured like the automatic setting device A of the first embodiment shown in FIG. 4, except for differences to be described below. Therefore, according to the automatic setting device A of the second embodiment, effects similar to those of the automatic setting device A of the first embodiment described above can be obtained, except for the differences to be described below.

A propulsion force setting unit A5 of the automatic setting device A of the second embodiment sets magnitudes and directions of propulsion forces which are generated by three or more ship propulsion devices on the basis of actual behavior of the ship 1 calculated by an actual behavior calculation unit A4 and target behavior of the ship 1 acquired by a target behavior acquisition unit A2.

An initial propulsion force setting unit A51 provided in the propulsion force setting unit A5 of the automatic setting device A of the second embodiment sets magnitudes and directions of propulsion forces that are initially generated by the three or more ship propulsion devices after an input operation setting unit A1 sets an input operation on, for example, an operation unit 11D of the ship 1, as magnitudes and directions of initial propulsion forces.

A propulsion force change unit A52 of the propulsion force setting unit A5 of the second embodiment changes at least one of the magnitudes and the directions of the propulsion forces that are generated by the three or more ship propulsion devices from the magnitudes and the directions of the initial propulsion forces set by the initial propulsion force setting unit A51 so that the actual behavior of the ship 1 calculated by the actual behavior calculation unit A4 approaches the target behavior of the ship 1 calculated by the target behavior acquisition unit A2.

A setting value storage unit A53 provided in the propulsion force setting unit A5 of the automatic setting device A of the second embodiment stores the magnitudes and the directions of the propulsion forces that are generated by the three or more ship propulsion devices when the actual behavior of the ship 1 is within an allowable range of the target behavior of the ship 1 as propulsion force setting values.

In the automatic setting device A of the second embodiment, a process of changing the propulsion forces that are generated by the three or more ship propulsion devices is executed so that the actual behavior of the ship 1 approaches the target behavior of the ship 1. That is, according to the automatic setting device A of the second embodiment, it is not necessary for the worker to perform all the work of changing the propulsion forces that are generated by the three or more ship propulsion devices so that the actual behavior of the ship 1 approaches the target behavior of the ship 1.

Also, in the automatic setting device A of the second embodiment, a process of storing the propulsion forces that are generated by the three or more ship propulsion devices when the actual behavior of the ship 1 is within the allowable range of the target behavior of the ship 1 is executed. That is, it is not necessary for the worker to store the propulsion forces that are generated by the three or more ship propulsion devices in a computer or the like when the actual behavior of the ship 1 is within the allowable range of the target behavior of the ship 1.

That is, all the setting of the control device 14 for the three or more ship propulsion devices is not performed in the work of the worker, but is performed in the process of the automatic setting device A.

As a result, the setting of the control device 14 for the three or more ship propulsion devices can be automatically performed without the need for the worker to perform all the setting work associated with the control device 14 for the three or more ship propulsion devices.

Also, it is possible to limit variations in setting of a plurality of control devices 14 as compared with the case where the setting processes associated with the plurality of control devices 14 are performed by a plurality of workers.

Also, in a first example of the automatic setting device A of the second embodiment, after the setting value storage unit A53 of the propulsion force setting unit A5 stores the magnitudes and the directions of the propulsion forces that are generated by the three or more ship propulsion devices when the ship 1 is turning clockwise on the spot as propulsion force setting values, the input operation setting unit A1 sets an input operation for causing the ship 1 to perform a translational movement in the right direction, the right-forward direction, or the right-backward direction as an input operation for the ship 1 and the initial propulsion force setting unit A51 of the propulsion force setting unit A5 sets the magnitudes and the directions of the propulsion forces that are generated by the three or more ship propulsion devices when the ship 1 is turning clockwise on the spot stored as the propulsion force setting values by the setting value storage unit A53 as the magnitudes and the directions of the initial propulsion forces.

Thus, in the first example of the automatic setting device A of the second embodiment, the magnitudes and the directions of the propulsion forces that are generated by the three or more ship propulsion devices when the ship 1 is turning clockwise on the spot may be used as they are as the magnitudes and the directions of the initial propulsion forces for implementing the rightward, right-forward, or right-backward translational movement of the ship 1.

Also, in a second example of the automatic setting device A of the second embodiment, after the setting value storage unit A53 of the propulsion force setting unit A5 stores the magnitudes and the directions of the propulsion forces that are generated by the three or more ship propulsion devices when the ship 1 is turning counterclockwise on the spot as propulsion force setting values, the input operation setting unit A1 sets an input operation for causing the ship 1 to perform a translational movement in the left, left-forward, or left-backward direction as an input operation for the ship 1 and the initial propulsion force setting unit A51 of the propulsion force setting unit A5 sets the magnitudes and the directions of the propulsion forces that are generated by the three or more ship propulsion devices when the ship 1 is turning counterclockwise on the spot stored as the propulsion force setting values by the setting value storage unit A53 as the magnitudes and the directions of the initial propulsion forces.

Thus, in the second example of the automatic setting device A of the second embodiment, the magnitudes and the directions of the propulsion forces that are generated by the three or more ship propulsion devices when the ship 1 is turning counterclockwise on the spot may be used as they are as the magnitudes and the directions of the initial propulsion forces for implementing the leftward, left-forward, or left-backward translational movement of the ship 1.

Although modes for carrying out the present invention have been described above using the embodiments, the present invention is not limited to the embodiments and various modifications and replacements can be applied without departing from the spirit and scope of the present invention. The configurations described in the above-described embodiments and the above-described examples may be combined.

Also, all or some of the functions of the parts provided in the automatic setting device A according to the above-described embodiment may be implemented by recording a program for implementing the functions on a computer-readable recording medium and causing a computer system to read and execute the program recorded on the recording medium. Also, the "computer system" described here is assumed to include an operating system (OS) and hardware such as peripheral devices.

Also, the "computer-readable recording medium" refers to a flexible disk, a magneto-optical disc, a ROM, a portable medium such as a CD-ROM, or a storage unit such as a hard disk embedded in the computer system. Further, the "computer-readable recording medium" may include a computer-readable recording medium for dynamically retaining the program for a short time period as in a communication line when the program is transmitted via a network such as the Internet or a communication circuit such as a telephone circuit and a computer-readable recording medium for retaining the program for a given time period as in a volatile memory inside the computer system including a server and a client when the program is transmitted. Also, the above-described program may be a program for implementing some of the above-described functions. Further, the above-described program may be a program capable of implementing the above-described function in combination with a program already recorded on the computer system.

REFERENCE SIGNS LIST

A Automatic setting device
A1 Input operation setting unit
A2 Target behavior acquisition unit
A3 Ship information acquisition unit
A31 Ship position information acquisition unit
A32 Ship bow direction information acquisition unit
A4 Actual behavior calculation unit
A5 Propulsion force setting unit
A51 Initial propulsion force setting unit
A52 Propulsion force change unit
A53 Setting value storage unit
1 Ship
11 Hull
111 Front portion
112 Rear portion
11A Steering device
11B Remote control device
11C Remote control device
11D Operation unit
P1 Position
P2 Position
P3 Position
P4 Position
P5 Position
P6 Position
P7 Position
P8 Position
P9 Position
12 Ship propulsion device
12A Ship propulsion device main body
12A1 Propulsion unit
12A2 Steering actuator
12AX Steering shaft
12B Bracket
13 Ship propulsion device
13A Ship propulsion device main body
13A1 Propulsion unit
13A2 Steering actuator
13AX Steering shaft
13B Bracket
14 Control device
14A Movement path calculation unit
14B Propulsion force calculation unit

What is claimed is:

1. An automatic setting device for automatically setting a control device for a plurality of ship propulsion devices configured to generate propulsion forces of a ship, the automatic setting device comprising:

an input operation setting unit configured to set an input operation for the ship;

a target behavior acquisition unit configured to acquire target behavior of the ship corresponding to the input operation set by the input operation setting unit;

a ship information acquisition unit configured to acquire ship information that is information about at least one of a position and a direction of the ship;

an actual behavior calculation unit configured to calculate actual behavior of the ship on the basis of the ship information acquired by the ship information acquisition unit; and a propulsion force setting unit configured to set a magnitude and a direction of a propulsion force that is generated by each of the plurality of ship propulsion devices on the basis of the actual behavior of the ship calculated by the actual behavior calculation unit and the target behavior of the ship acquired by the target behavior acquisition unit, wherein the propulsion force setting unit comprises an initial propulsion force setting unit configured to set a magnitude and a direction of a propulsion force that is initially generated by each of the plurality of ship propulsion devices as a magnitude and a direction of an initial propulsion force after the input operation for the ship is set by the input operation setting unit; and a setting value storage unit configured to store the magnitude and the direction of the propulsion force generated by each of the plurality of ship propulsion devices as propulsion force setting values when the actual behavior of the ship is within an allowable range of the target behavior of the ship.

2. The automatic setting device according to claim 1, wherein the propulsion force setting unit further comprises a propulsion force change unit configured to change at least one of the magnitude and the direction of the propulsion force generated by each of the plurality of ship propulsion devices from the magnitude and the direction of the initial propulsion force set by the initial propulsion force setting unit so that the actual behavior of the ship calculated by the actual behavior calculation unit approaches the target behavior of the ship acquired by the target behavior acquisition unit.

3. The automatic setting device according to claim 2, wherein, if the input operation setting unit sets an input operation for turning the ship clockwise on the spot as the input operation for the ship, the setting value storage unit stores the magnitude and the direction of the propulsion force generated by each of the plurality of ship propulsion devices as the propulsion force setting values when the ship is turning clockwise on the spot, and the input operation setting unit subsequently sets an input operation for causing the ship to perform a translational movement in a right direction, a right-forward direction, or a right-backward direction as the input operation for the ship, wherein the initial propulsion force setting unit sets the magnitude and the direction of the propulsion force generated by each of the plurality of ship propulsion devices when the ship is turning clockwise on the spot stored as the propulsion force setting values by the setting value storage unit as the magnitude and the direction of the initial propulsion force, and wherein the propulsion force change unit changes at least one of the magnitude and the direction of the propulsion force generated by each of the plurality of ship propulsion devices from a magnitude and a direction of a propulsion force for turning the ship clockwise on the spot so that the actual behavior of the ship calculated by the actual behavior calculation unit approaches a rightward, right-forward, or right-backward translational movement of the ship.

4. The automatic setting device according to claim 3, wherein the ship comprises a right ship propulsion device disposed on a right part of a rear portion of a hull and a left ship propulsion device disposed on a left part of the rear portion of the hull, wherein, if the input operation setting unit sets an input operation for turning the ship clockwise on the spot as the input operation for the ship, the setting value storage unit stores a backward direction of the ship as a direction of a propulsion force generated by the right ship propulsion device when the ship is turning clockwise on the spot and stores a forward direction of the ship as a direction of a propulsion force generated by the left ship propulsion device when the ship is turning clockwise on the spot, and the input operation setting unit subsequently sets an input operation for causing the ship to perform a translational movement in a right direction, a right-forward direction, or a right-backward direction as the input operation for the ship, wherein the initial propulsion force setting unit sets a backward direction of the ship as the direction of the propulsion force initially generated by the right ship propulsion device after an input operation for causing the ship to perform a translational movement in the right direction, the right-forward direction, or the right-backward direction is set and sets a forward direction of the ship as the direction of the propulsion force initially generated by the left ship propulsion device after the input operation for causing the ship to perform the translational movement in the right direction, the right-forward direction, or the right-backward direction is set, and wherein the propulsion force change unit changes the direction of the propulsion force generated by the right ship propulsion device from the backward direction to the right-backward direction of the ship and changes the direction of the propulsion force generated by the left ship propulsion device from the forward direction to the right-forward direction of the ship.

5. The automatic setting device according to claim 3, wherein, after a setting of the magnitude and the direction of the propulsion force generated by each of the plurality of ship propulsion devices when the ship turns clockwise on the spot, a setting of the magnitude and the direction of the propulsion force generated by each of the plurality of ship propulsion devices when the ship performs a translational movement in a right direction, a setting of the magnitude and the direction of the propulsion force generated by each of the plurality of ship propulsion devices when the ship performs a translational movement in a right-forward direction, and a setting of the magnitude and the direction of the propulsion force generated by each of the plurality of ship propulsion devices when the ship performs a translational movement in a right-backward direction are completed, the propulsion force setting unit sets the magnitude and the direction of the propulsion force generated by each of the plurality of ship propulsion devices when the ship moves forward or backward.

6. The automatic setting device according to claim 2, wherein, if the input operation setting unit sets an input operation for turning the ship counterclockwise on the spot as the input operation for the ship, the setting value storage unit stores the magnitude and the direction of the propulsion force generated by each of the plurality of ship propulsion devices as the propulsion force setting values when the ship is turning counterclockwise on the spot, and the input operation setting unit subsequently sets an input operation for causing the ship to perform a translational movement in a left direction, a left-forward direction, or a left-backward direction as the input operation for the ship, wherein the initial propulsion force setting unit sets the magnitude and the direction of the propulsion force generated by each of the plurality of ship propulsion devices when the ship is turning counterclockwise on the spot stored as the propulsion force setting values by the setting value storage unit as the magnitude and the direction of the initial propulsion force, and wherein the propulsion force change unit changes at least one of the magnitude and the direction of the propulsion force generated by each of the plurality of ship propulsion devices from a magnitude and a direction of a propulsion force for turning the ship counterclockwise on the spot so that the actual behavior of the ship calculated by the actual behavior calculation unit approaches a leftward, left-forward, or left-backward translational movement of the ship.

7. The automatic setting device according to claim 6, wherein the ship comprises a right ship propulsion device disposed on a right part of a rear portion of a hull and a left ship propulsion device disposed on a left part of the rear portion of the hull, wherein, if the input operation setting unit sets an input operation for turning the ship counterclockwise on the spot as the input operation for the ship, the setting value storage unit stores a forward direction of the ship as a direction of a propulsion force generated by the right ship propulsion device when the ship is turning counterclockwise on the spot and stores a backward direction of the ship as a direction of a propulsion force generated by the left ship propulsion device when the ship is turning counterclockwise on the spot, and the input operation setting unit subsequently sets an input operation for causing the ship to perform a translational movement in a left direction, a left-forward direction, or a left-backward direction as the input operation for the ship, wherein the initial propulsion force setting unit sets a forward direction of the ship as the direction of the propulsion force initially generated by the right ship propulsion device after an input operation for causing the ship to perform a translational movement in the left direction, the left-forward direction, or the left-backward direction is set and sets a backward direction of the ship as the direction of the propulsion force initially generated by the left ship propulsion device after the input operation for causing the ship to perform the translational movement in the left direction, the left-forward direction, or the left-backward direction is set, and wherein the propulsion force change unit changes the direction of the propulsion force generated by the right ship propulsion device from the forward direction to the left-forward direction of the ship and changes the direction of the propulsion force generated by the left ship propulsion device from the backward direction to the left-backward direction of the ship.

8. The automatic setting device according to claim 6, wherein, after a setting of the magnitude and the direction of the propulsion force generated by each of the plurality of ship propulsion devices when the ship turns counterclockwise on the spot, a setting of the magnitude and the direction of the propulsion force generated by each of the plurality of ship propulsion devices when the ship performs a translational movement in a left direction, a setting of the magnitude and the direction of the propulsion force generated by each of the plurality of ship propulsion devices when the ship performs a translational movement in a left-forward direction, and a setting of the magnitude and the direction of the propulsion force generated by each of the plurality of ship propulsion devices when the ship performs a translational movement in a left-backward direction are completed, the propulsion force setting unit sets the magnitude and the direction of the propulsion force generated by each of the plurality of ship propulsion devices when the ship moves forward or backward.

9. An automatic setting method of automatically setting a control device for a plurality of ship propulsion devices configured to generate propulsion forces of a ship, the automatic setting method comprising:

an input operation setting step of setting an input operation for the ship;

a target behavior acquisition step of acquiring target behavior of the ship corresponding to the input operation set in the input operation setting step;

a ship information acquisition step of acquiring ship information that is information about at least one of a position and a direction of the ship;

an actual behavior calculation step of calculating actual behavior of the ship on the basis of the ship information acquired in the ship information acquisition step; and a propulsion force setting step of setting a magnitude and a direction of a propulsion force that is generated by each of the plurality of ship propulsion devices on the basis of the actual behavior of the ship calculated in the actual behavior calculation step and the target behavior of the ship acquired in the target behavior acquisition step, wherein the propulsion force setting step comprises an initial propulsion force setting step of setting a magnitude and a direction of a propulsion force that is initially generated by each of the plurality of ship propulsion devices as a magnitude and a direction of an initial propulsion force after the input operation for the ship is set in the input operation setting step; and a setting value storage step of storing the magnitude and the direction of the propulsion force generated by each of the plurality of ship propulsion devices as propulsion force setting values when the actual behavior of the ship is within an allowable range of the target behavior of the ship.

10. A program for automatically setting a control device for a plurality of ship propulsion devices configured to generate propulsion forces of a ship, the program causing a computer to execute:

an input operation setting step of setting an input operation for the ship;

a target behavior acquisition step of acquiring target behavior of the ship corresponding to the input operation set in the input operation setting step;

a ship information acquisition step of acquiring ship information that is information about at least one of a position and a direction of the ship;

an actual behavior calculation step of calculating actual behavior of the ship on the basis of the ship information acquired in the ship information acquisition step; and a propulsion force setting step of setting a magnitude and a direction of a propulsion force that is generated by each of the plurality of ship propulsion devices on the basis of the actual behavior of the ship calculated in the actual behavior calculation step and the target behavior of the ship acquired in the target behavior acquisition step, wherein the propulsion force setting step comprises an initial propulsion force setting step of setting a magnitude and a direction of a propulsion force that is initially generated by each of the plurality of ship propulsion devices as a magnitude and a direction of an initial propulsion force after the input operation for the ship is set in the input operation setting step; and a setting value storage step of storing the magnitude and the direction of the propulsion force generated by each of the plurality of ship propulsion devices as propulsion force setting values when the actual behavior of the ship is within an allowable range of the target behavior of the ship.

* * * * *